US006964587B2

(12) United States Patent
Colantuono et al.

(10) Patent No.: US 6,964,587 B2
(45) Date of Patent: Nov. 15, 2005

(54) HIGH PERFORMANCE, HIGH CAPACITANCE GAIN, JACK CONNECTOR FOR DATA TRANSMISSION OR THE LIKE

(75) Inventors: Robert G. Colantuono, Dover, PA (US); Richard D. Marowsky, York, PA (US); Jason A. Cowburn, York, PA (US); Dennis A. Bush, York, PA (US)

(73) Assignee: Bel Fuse Ltd., Kowloon (HK)

( * ) Notice: Subject to any disclaimer, the term of this patent is extended or adjusted under 35 U.S.C. 154(b) by 0 days.

(21) Appl. No.: 10/292,089

(22) Filed: Nov. 10, 2002

(65) Prior Publication Data

US 2004/0092170 A1 May 13, 2004

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS

| | | | | |
|---|---|---|---|---|
| T961,003 | I4 | 8/1977 | Krumreich | 339/176 M |
| 4,274,691 | A | 6/1981 | Abernethy et al. | 339/19 |
| 4,734,043 | A | 3/1988 | Emert et al. | 439/65 |
| 4,978,317 | A | 12/1990 | Pocrass | 439/490 |
| 5,037,330 | A | 8/1991 | Fulponi et al. | 439/607 |
| 5,094,631 | A | 3/1992 | Suzuki | 439/676 |
| 5,178,563 | A | 1/1993 | Reed | 439/676 |
| 5,186,647 | A | 2/1993 | Denkmann et al. | 439/395 |
| 5,226,835 | A | 7/1993 | Baker, III et al. | 439/403 |
| 5,269,708 | A | 12/1993 | DeYoung et al. | 439/676 |
| 5,281,169 | A | 1/1994 | Kiat et al. | 439/607 |
| 5,282,754 | A | 2/1994 | Kish et al. | 439/108 |
| 5,299,956 | A | 4/1994 | Brownell et al. | 439/638 |
| 5,310,363 | A | 5/1994 | Brownell et al. | 439/676 |

(Continued)

FOREIGN PATENT DOCUMENTS

| | | |
|---|---|---|
| WO | WO9706584 | 2/1997 |

(Continued)

*Primary Examiner*—P. Austin Bradley
*Assistant Examiner*—X. Chung-Trans
(74) *Attorney, Agent, or Firm*—Steinberg & Raskin, P.C.

(57) ABSTRACT

A high performance, high capacitance gain, electric connector for data transfer applications. At least eight sequentially positioned elongate contact members are connected in a series of signal pairs. A first signal pair includes a fourth contact member and a fifth contact member. A second signal pair includes a third contact member and a sixth contact member. In addition, a third signal pair comprises a first contact member and a second contact member. Finally, a seventh and an eighth contact member are in a fourth signal pair. One member of each contact member pair is configured differently from the other member of the pair, the respective contact members being oriented relative to one another such that they substantially remain in generally parallel planes, but define non-parallel paths. Each of the third and fifth contact members mounts a plate-like extension oriented in a first direction and in respective planes generally parallel to one another. Each pair of extensions are separated by a first dielectric such that a first capacitor is formed. Furthermore, each of the fourth and sixth contact members mounts a plate-like extension oriented in a second direction and also in respective planes generally parallel to one another. Each pair of extensions are likewise separated by a second dielectric such that a second capacitor is formed. Each contact of each contact member pair has a plug engaging portion and a board engaging portion, the plurality of contact members having a selected shape, being arranged relative to one another, and being housed collectively by a dielectric casing so as to minimize crosstalk during data transfer.

39 Claims, 27 Drawing Sheets

U.S. PATENT DOCUMENTS

| | | | | |
|---|---|---|---|---|
| 5,328,390 | A | | 7/1994 | Johnston et al. ..... 439/638 |
| 5,350,324 | A | | 9/1994 | Guilbert ..... 439/894 |
| 5,362,257 | A | | 11/1994 | Neal et al. ..... 439/676 |
| 5,399,107 | A | | 3/1995 | Gentry et al. ..... 439/676 |
| 5,403,200 | A | | 4/1995 | Chen ..... 439/404 |
| 5,414,393 | A | | 5/1995 | Rose et al. ..... 333/1 |
| 5,431,584 | A | | 7/1995 | Ferry ..... 439/620 |
| 5,432,484 | A | | 7/1995 | Klas et al. ..... 333/1 |
| 5,454,738 | A | | 10/1995 | Lim et al. ..... 439/676 |
| 5,456,619 | A | | 10/1995 | Belopolsky et al. ..... 439/620 |
| 5,531,612 | A | | 7/1996 | Goodall et al. ..... 439/541.5 |
| 5,547,405 | A | | 8/1996 | Pinney et al. ..... 439/894 |
| 5,556,307 | A | | 9/1996 | Johnston ..... 439/676 |
| 5,562,479 | A | | 10/1996 | Pallas et al. ..... 439/404 |
| 5,571,035 | A | | 11/1996 | Ferrill ..... 439/894 |
| 5,580,270 | A | | 12/1996 | Pantland et al. ..... 439/395 |
| 5,586,914 | A | | 12/1996 | Foster, Jr. et al. ..... 439/676 |
| 5,601,451 | A | | 2/1997 | Driones et al. ..... 439/490 |
| 5,613,873 | A | | 3/1997 | Bell, Jr. ..... 439/490 |
| 5,618,185 | A | | 4/1997 | Aekins ..... 439/76.1 |
| 5,626,497 | A | | 5/1997 | Bouchan et al. ..... 439/676 |
| 5,639,267 | A | | 6/1997 | Loudermilk ..... 439/701 |
| 5,647,770 | A | | 7/1997 | Belopolsky ..... 439/676 |
| 5,685,737 | A | | 11/1997 | Morin et al. ..... 439/490 |
| 5,716,237 | A | * | 2/1998 | Conorich et al. ..... 439/660 |
| 5,791,942 | A | * | 8/1998 | Patel ..... 439/637 |
| 5,797,770 | A | | 8/1998 | Davis et al. ..... 439/607 |
| 5,989,071 | A | * | 11/1999 | Larsen et al. ..... 439/676 |
| 6,042,427 | A | * | 3/2000 | Adriaenssens et al. ..... 439/676 |
| 6,159,039 | A | | 12/2000 | Wu ..... 439/541.5 |
| 6,162,089 | A | | 12/2000 | Costello et al. ..... 439/541.5 |
| 6,290,524 | B1 | * | 9/2001 | Simmel ..... 439/289 |

FOREIGN PATENT DOCUMENTS

| | | |
|---|---|---|
| WO | WO9710628 | 3/1997 |

* cited by examiner

HIGH PERFORMANCE, HIGH CAPACITANCE GAIN, JACK CONNECTOR FOR DATA TRANSMISSION OR THE LIKE

BACKGROUND OF THE INVENTION

The present invention relates generally to electric connectors and, more particularly, to an interference inhibiting, electric connector for use in high frequency data communications or the like.

Conventional jack connectors for data communications are characterized by a dielectric housing with a series of contacts positioned within the housing in relatively close proximity to one another. The jack contacts establish electrical connection between a corresponding wire conductor at one end of the contact and plug contacts and circuits on a printed circuit board on which the jack is mounted.

In locating the contacts in relative proximity to one another, especially during high performance communications, the contacts themselves become antennae for both broadcasting and receiving electromagnetic radiation. This leads to signal coupling between different pairs of contacts, a phenomenon commonly known as crosstalk. Crosstalk is a source of interference, characterized quantitatively by a signal-to-noise ratio that degrades the processing of incoming signals. As the frequency of interfering signals due to crosstalk and associated error rate increases, namely, during high performance communications, crosstalk becomes increasingly significant, often interfering with and otherwise obstructing data transfer.

Efforts have been made to reduce and even eliminate crosstalk in a variety of electrical applications. Of particular importance, in recent years, has been crosstalk reduction during high speed, high volume data transmission between wireless devices, computers or the like, especially in data streaming and video conferencing applications. Methods for reducing crosstalk have ranged from placement of the contacts in a crossed configuration to altering the geometry of the contacts themselves. Exemplary techniques include reverse-mounting and superimposition of the contacts, such as shown generally in U.S. Pat. No. 5,626,497, non-contact overlapping and cross-over of contact-pairs, as provided in U.S. Pat. No. 5,362,257, as well as twisting of the contacts with one another.

Geometric variation of the connector structure has also been found helpful in compensating for and/or substantially cancelling crosstalk. Such approaches include minimizing the surface area of contact blades and altering the contacts' placement relative to one another. An example of this approach is provided in U.S. Pat. No. 5,586,914.

Still another geometry-related construction for reducing crosstalk, namely, between contacts of two signal pairs, is to form capacitive couplings between the contacts of different signal pairs by utilizing extensions that extend laterally from the respective contacts. For example, U.S. Pat. No. 5,547,405 shows a crosstalk suppressing connector with two pairs of signal-carrying contacts. Each secondary contact is capacitively coupled to an initial contact of the other pair by a lateral extension formed in one of the contacts which overlies the other contact in a local region of limited length. This arrangement has also been found beneficial for crosstalk reduction.

Another approach to crosstalk mitigation has been to sever signal paths of selected connector contacts, then re-route them through a filter circuit in order to balance mutual inductance. Balancing inductance is a known crosstalk reducer. Illustrations of such techniques are set forth, for instance, in U.S. Pat. Nos. 5,470,244 and 5,454,738. Other useful techniques include the placement of dielectric spacers or inserts between contacts within the housing. Representative applications of insulation displacement connectors and dielectric inserts for crosstalk reduction may be found in U.S. Pat. Nos. 5,226,835 and 5,571,035, respectively.

Although prior attempts at crosstalk reduction have met with some success, they have been found not only difficult and costly to implement, but also of limited durability and reliability. Moreover, with the ever increasing speed of data communications, crosstalk produced at electric connections has intensified, necessitating further advances in crosstalk inhibition technology.

An electric connector is, therefore, desired that provides high performance data communication, that is simple and economical to produce, and that facilitates optimum data transfer with increasing frequency of transmission without signal degradation due to crosstalk.

SUMMARY OF THE INVENTION

Accordingly, one object of the present invention to provide an electric connector for high performance applications with enhanced crosstalk compensation features.

Another object of the present invention is to provide an electric connector for high performance data communication that is simple and economical to produce.

A further object of the present invention is to provide an electric connector that provides for optimum data transfer during high frequency transmission without crosstalk interference.

Still another object of the present invention is to provide an improved electric connector that maintains an optimum level of data transfer with increasing frequency of transmission and without signal degradation due to crosstalk.

Yet another object of the present invention is to provide an electric connector with improved crosstalk compensation features.

Still a further object of the present invention is to provide enhanced crosstalk compensation in an electric connector through implementation of capacitors passively within the wire set.

Yet a further object of the present invention is to provide a passive, high performance, high capacitance gain, electric connector for data transmission or the like.

Another object of the present invention is to provide a high performance electric connector that is both practical and economical.

Still another object of the present invention is to passively provide for enhanced crosstalk reduction.

Yet a further object of the present invention is to provide means for eliminating crosstalk that may be readily integrated in the design of existing electric connectors with minimal redesign.

Yet another object of the present invention is to provide enhanced crosstalk compensation in an electric connector through crossed contact members and implementation of capacitors passively within the wire set.

A further object of the present invention is to provide a method for optimum data transfer during high frequency transmission without crosstalk interference.

Briefly, in accordance with one aspect of the present invention, these and other objects are attained by providing an electric connector for data transfer applications. The connector comprises at least four elongate contact members connected in at least two signal pairs. A first signal pair includes a second contact member and a third contact member, and a second signal pair comprises a first contact member and a fourth contact member. One member of each pair is configured differently from the other member of the pair, the respective members being oriented relative to one another such that they substantially remain in generally parallel planes, but define non-parallel paths. Each of the first and third members mounts a plate-like extension oriented in a first direction and in respective planes generally parallel to one another. The extensions are spaced apart a selected distance, each pair of extensions being separated by a first dielectric such that a first capacitor is formed. Each of the second and fourth members mounts a plate-like extension oriented in a second direction also in respective planes generally parallel to one another. Each pair of extensions are likewise separated by a second dielectric such that a second capacitor is formed. Each contact member of each signal pair has a plug engaging portion and a board engaging portion, the plurality of contact members having a selected shape, being arranged relative to one another, and being housed collectively by a dielectric casing so as to minimize crosstalk during data transfer.

According to another aspect of the present invention, there is provided an electric connector for data transfer applications. The connector comprises at least eight elongate contact members connected in at least two signal pairs. A first signal pair includes a fourth contact member and a fifth contact member, and a second signal pair comprises a third contact member and a sixth contact member. One member of each pair is configured differently from the other member of the pair, the respective members being oriented relative to one another such that they remain in generally parallel planes, but define non-parallel paths. Each of the third and fifth members mounts a plate-like extension oriented in a first direction and in respective planes generally parallel to one another. The extensions are spaced apart a selected distance, each pair of extensions being separated by a first dielectric such that a first capacitor is formed. Each of the fourth and sixth members mounts a plate-like extension oriented in a second direction also in respective planes generally parallel to one another. Each pair of extensions are likewise separated by a second dielectric such that a second capacitor is formed. Each contact member of each signal pair has a plug engaging portion and a board engaging portion, the plurality of contact members having a selected shape, being arranged relative to one another, and being housed collectively by a dielectric casing so as to minimize crosstalk during data transfer.

In accordance with a further aspect of the present invention, there is provided a high performance, high capacitance gain, electric connector for data transfer applications. The connector comprises at least eight sequentially positioned contacts connected in at least four signal pairs. A first signal pair includes a fourth contact and a fifth contact. A second signal pair includes a third contact and a sixth contact. In addition, a third signal pair comprises a first contact and a second contact. Finally, a seventh and an eighth contact are in a fourth signal pair. One contact of each pair is configured differently from the other contact of the pair, the respective contacts being oriented relative to one another such that they remain in generally parallel planes, but define non-parallel paths. Each of the third and fifth contacts mounts a plate-like extension oriented in a first direction and in respective planes generally parallel to one another. Each pair of extensions is separated by a first dielectric such that a first capacitor is formed. Furthermore, each of the fourth and sixth contacts mounts a plate-like extension oriented in a second direction and also in respective planes generally parallel to one another. Each pair of extensions are likewise separated by a second dielectric such that a second capacitor is formed. Finally, each contact of each contact pair has a plug engaging portion and a board engaging portion, the plurality of contacts having a selected shape, being arranged relative to one another, and being housed collectively by a dielectric casing so as to minimize crosstalk during high frequency data transfer.

According to another aspect of the present invention, there is provided an electric connector for data transfer applications. The connector comprises at least eight elongate contact members connected in a plurality of signal pairs. A first signal pair includes a fourth contact member and a fifth contact member. A second signal pair includes a third contact member and a sixth contact member. In addition, a third signal pair comprises a first contact member and a second contact member. Finally, a seventh and an eighth contact member constitute a fourth signal pair. One member of each pair is configured differently from the other member of the pair, the respective members being oriented relative to one another such that they remain in generally parallel planes, but define non-parallel paths. Each of the third and fifth members mounts a plate-like extension oriented in a first direction and in respective planes generally parallel to one another. The extensions are spaced apart a selected distance, each pair of extensions being separated by a first dielectric such that a first capacitor is formed. Each of the fourth and sixth members mounts a plate-like extension oriented in a second direction also in respective planes generally parallel to one another. Each pair of extensions are likewise separated by a second dielectric such that a second capacitor is formed. Each contact member of each signal pair has a plug engaging portion and a board engaging portion, the plurality of contact members having a selected shape, being arranged relative to one another, and being housed collectively by a dielectric casing so as to minimize crosstalk during data transfer.

In accordance with a further aspect of the present invention, there is provided a high performance, high capacitance gain, electric connector for data transfer applications. The connector comprises at least eight sequentially positioned contacts connected in a plurality of signal pairs. A first signal pair includes a fourth contact and a fifth contact. A second signal pair includes a third contact and a sixth contact. A third signal pair comprises a first contact and a second contact. Similarly, a seventh contact and an eighth contact are in a fourth signal pair. One contact of each pair is configured differently from the other contact of the pair, the respective contacts being oriented relative to one another such that they remain in generally parallel planes, but define non-parallel paths. Each of the third and fifth contacts mounts a plate-like extension oriented in a first direction and in respective planes generally parallel to one another. Each pair of extensions are separated by a first dielectric such that a first capacitor is formed. Furthermore, each of the fourth and sixth contacts mounts a plate-like extension oriented in a second direction and in respective planes generally parallel to one another. Each pair of extensions are likewise separated by a second dielectric such that a second capacitor is formed. Moreover, the total surface area of the extensions of the first capacitor are generally equal to that of the second capacitor extensions. Finally, each contact of each contact pair has a plug engaging portion and a board engaging portion, the plurality of contacts having a selected shape, being arranged relative to one another, and being housed collectively by a dielectric casing so as to minimize crosstalk during high frequency data transfer.

In accordance with yet another aspect of the present invention, there is provided a high performance, high capacitance gain, electric connector for data transfer applications. The connector comprises at least eight sequentially positioned contacts connected in a plurality of signal pairs. A first signal pair includes a fourth contact and a fifth contact. A second signal pair includes a third contact and a sixth contact. A third signal pair comprises a first contact and a second contact. Similarly, a seventh contact and an eighth contact are in a fourth signal pair. One contact of each pair is configured differently from the other contact of the pair, the respective contacts being oriented relative to one another such that they remain in generally parallel planes, but define non-parallel paths. Each of the third and fifth contacts mounts a plate-like extension oriented in a first direction and in respective planes generally parallel to one another. Each pair of extensions are separated by a first dielectric such that a first capacitor is formed. Furthermore, each of the fourth and sixth contacts mounts a plate-like extension oriented in a second direction and in respective planes generally parallel to one another. Each pair of extensions are likewise separated by a second dielectric such that a second capacitor is formed. Moreover, the total surface area of the extensions of the first capacitor are generally unequal to that of the second capacitor extensions. Finally, each contact of each contact pair has a plug engaging portion and a board engaging portion, the plurality of contacts having a selected shape, being arranged relative to one another, and being housed collectively by a dielectric casing so as to minimize crosstalk during high frequency data transfer.

According to a further aspect of the present invention, there is provided a high performance, high capacitance gain, electric connector for data transfer applications. The connector comprises at least eight sequentially positioned elongate contact members connected in a plurality of signal pairs. A first signal pair comprises a fourth contact member and a fifth contact member, and a second signal pair includes a third contact member and a sixth contact member. Each of the third and fifth contact members mounts a plate-like extension oriented in a first direction and in respective planes generally parallel to one another. Each pair of extensions are separated by a first dielectric having a relatively high dielectric value such that a first high gain capacitor is formed. Similarly, each of the fourth and sixth contact members mounts a plate-like extension oriented in a second direction and in respective planes generally parallel to one another. Each pair of extensions are likewise separated by a second dielectric having a relatively high dielectric value such that a second high gain capacitor is formed. Furthermore, each contact member of each contact member pair has a plug engaging portion and a board engaging portion, the plurality of contact members having a selected shape, being arranged relative to one another, and being housed collectively by a dielectric casing so as to minimize crosstalk during high frequency data transfer.

According to still another aspect of the present invention, there is provided a high performance, high capacitance gain, electric connector for data transfer applications. The connector comprises at least eight sequentially positioned elongate contact members connected in a plurality of signal pairs. A first signal pair comprises a fourth contact member and a fifth contact member, and a second signal pair includes a third contact member and a sixth contact member. Each of the third and fifth contact members mounts a plate-like extension oriented in a first direction and in respective planes generally parallel to one another. Each pair of extensions are separated by a first dielectric having a relatively high dielectric value such that a first high gain capacitor is formed. Similarly, each of the fourth and sixth contact members mounts a plate-like extension oriented in a second direction and in respective planes generally parallel to one another. Each pair of extensions are likewise separated by a second dielectric having a relatively high dielectric value such that a second high gain capacitor is formed. Moreover, the eighth contact member mounts a plate-like extension oriented in a third direction and in a plane generally parallel to that of the sixth member. The sixth and eighth member extensions being separated by a third dielectric such that a third capacitor is formed. Furthermore, each contact member of each contact member pair has a plug engaging portion and a board engaging portion, the plurality of contact members having a selected shape, being arranged relative to one another, and being housed collectively by a dielectric casing so as to minimize crosstalk during high frequency data transfer.

In accordance with still a further aspect of the present invention is an electric connector for data transfer applications which comprises at least four elongate contact members connected in at least two signal pairs. A first signal pair includes a second contact member and a third contact member, and a second signal pair comprises a first contact member and a fourth contact member. One member of each pair is configured differently from the other member of the pair, the respective members being oriented relative to one another such that they substantially remain in generally parallel planes, but define non-parallel paths. Also, one member of each signal pair crosses over the other member of the pair such that the positions occupied by the respective members along their non-parallel paths are reversed. Moreover, each of the first and third members mounts a plate-like extension oriented in a first direction and in respective planes generally parallel to one another. The extensions are spaced apart a selected distance, each pair of extensions being separated by a first dielectric such that a first capacitor is formed. Each of the second and fourth members mounts a plate-like extension oriented in a second direction also in respective planes generally parallel to one another. Each pair of extensions are likewise separated by a second dielectric such that a second capacitor is formed. Each contact member of each signal pair has a plug engaging portion and a board engaging portion, the plurality of contact members having a selected shape, being arranged relative to one another, and being housed collectively by a dielectric casing so as to minimize crosstalk during data transfer.

According to another aspect of the present invention, there is provided a high performance, high capacitance gain, electric connector for data transfer applications. The connector comprises at least eight sequentially positioned contacts connected in a plurality of signal pairs. A first signal pair includes a fourth contact and a fifth contact. A second signal pair includes a third contact and a sixth contact. A third signal pair comprises a first contact and a second contact. Similarly, a seventh contact and an eighth contact are in a fourth signal pair. One contact of each pair is configured differently from the other contact of the pair, the respective contacts being oriented relative to one another such that they substantially remain in generally parallel planes, but define non-parallel paths. Also, one contact of each of the first, third and fourth signal pairs crosses over the other contact of the pair such that the positions occupied by the respective contacts along their non-parallel paths are reversed. Moreover, each of the third and fifth contacts mounts a plate-like extension oriented in a first direction and in respective planes generally parallel to one another. Each pair of extensions are separated by a first dielectric such that a first capacitor is formed. Furthermore, each of the fourth and sixth contacts mounts a plate-like extension oriented in a second direction and in respective planes generally parallel to one another. Each pair of extensions are likewise separated by a second dielectric such that a second capacitor is formed. Finally, each contact of each contact pair has a plug engaging portion and a board engaging portion, the plurality of contacts having a selected shape, being arranged relative to one another, and being housed collectively by a dielectric casing so as to minimize crosstalk during high frequency data transfer.

According to a further aspect of the present invention, there is provided a high performance, high capacitance gain, electric connector for data transfer applications. The connector comprises at least eight sequentially positioned contacts connected in a plurality of signal pairs. A first signal pair includes a fourth contact and a fifth contact. A second signal pair includes a third contact and a sixth contact. A third signal pair comprises a first contact and a second contact. Similarly, a seventh contact and an eighth contact are in a fourth signal pair. One contact of each pair is configured differently from the other contact of the pair, and the respective contacts of each pair being oriented relative to one another such that they substantially remain in generally parallel planes, but define non-parallel paths. Also, one contact of each of the first, third and fourth signal pairs crosses over the other contact of the pair such that the positions occupied by the respective contacts along their non-parallel paths are reversed. Moreover, each of the third and fifth contacts mounts a plate-like extension oriented in a first direction and in respective planes generally parallel to one another. Each pair of extensions are separated by a first dielectric such that a first capacitor is formed. Furthermore, each of the fourth and sixth contacts mounts a plate-like extension oriented in the same general direction as the first direction, and in respective planes generally parallel to one another. Each pair of extensions are likewise separated by a second dielectric such that a second capacitor is formed. Finally, each contact of each contact pair has a plug engaging portion and a board engaging portion, the plurality of contacts having a selected shape, being arranged relative to one another, and being housed collectively by a dielectric casing so as to minimize crosstalk during high frequency data transfer.

In accordance with yet another aspect of the present invention is a method of assembling an electric connector for data transfer applications. First, at least four elongate contact members are connected in at least two signal pairs. A second one of the contact members is paired with a third one of the contact members to form a first signal pair. A first one of the contact members is paired with a fourth one of the contact members to form a second signal pair. Such pairing is done such that one contact member of each contact member pair is configured differently from the other contact member of the pair, the respective contact members being oriented relative to one another such that they remain in generally parallel planes, but define non-parallel paths. Next, a plate-like extension is mounted to each of the first and third contact members. Each plate-like extension is oriented in a first direction and in respective planes generally parallel to one another, and each pair of extensions are separated by a first dielectric such that a first capacitor is formed. Thereafter, a plate-like extension is mounted to each of the second and fourth contact member. Each plate-like extension is oriented in a second direction and in respective planes generally parallel to one another, and each pair of extensions are separated by a second dielectric such that a second capacitor is formed. Finally, a plug engaging portion and a board engaging portion is formed on each contact member pair, the plurality of contact members having a selected shape, being arranged relative to one another, and being housed collectively by a dielectric casing so as to minimize crosstalk during high frequency data transfer.

According to yet a further aspect of the present invention, there is provided a method of assembling a electric connector for data transfer applications. Initially, at least eight elongate contact members are connected in a series of four signal pairs. A fourth one of the contact members is paired with a fifth one of the contact members so as to form a first signal pair. A second signal pair is formed of a third one of the contact members and a sixth one of the contact members. Then, a first one of the contact members and a second one of the contact members are formed in a third signal pair. Finally, a seventh one of the contact members and an eighth one of the contact members are arranged to form a fourth signal pair. One contact member of each contact member pair is configured differently from the other member of the pair, the respective members being oriented relative to one another such that they remain in generally parallel planes, but define non-parallel paths. Each of the third and fifth contact members mounts a plate-like extension oriented in a first direction and in respective planes generally parallel to one another. Each pair of extensions are separated by a first dielectric such that a first capacitor is formed. Furthermore, each of the fourth and sixth contact members mounts a plate-like extension oriented in a second direction and also in respective planes generally parallel to one another. Each pair of extensions are likewise separated by a second dielectric such that a second capacitor is formed. Finally, each contact member of each contact member pair has a plug engaging portion and a board engaging portion, the plurality of contact members having a selected shape, being arranged relative to one another, and being housed collectively by a dielectric casing so as to minimize crosstalk during high frequency data transfer.

According to another aspect of the present invention is a method of assembling an electric connector for data transfer applications. First, at least eight elongate contact members are formed such that each contact member has a plug engaging portion and a board engaging portion. At least two of the contact members are formed to each have a plate-like extension oriented in a first direction and in respective planes generally parallel to one another. At least two contact members are formed to each have a plate-like extension oriented in a second direction and in respective planes generally parallel to one another. Finally, each of the contact members are formed of a selected shape suitable for minimizing crosstalk during high frequency data transfer. Next, the contact members are arranged in sequential positions and connected in a series of signal pairs. In particular, a fourth one of the members is paired with a fifth one of the members to form a first signal pair. A third one of the members is paired with a sixth one of the members to form a second signal pair. A first one of the members is paired with a second one of the members to form a third signal pair, and a fourth signal pair is formed by pairing a seventh one of the members with an eighth one of the members. The members are also formed such that one contact member of each pair is configured differently from the other contact member of the pair, the respective members being oriented relative to one another such that they remain in generally parallel planes, but define non-parallel paths. Thereafter, each of the two contact members having plate-like extensions oriented in a first direction and in respective planes generally parallel to one another, are separated by a first dielectric such that a first capacitor is formed. Likewise, each of the two contact members having plate-like extensions oriented in a second direction and in respective planes generally parallel to one another, are separated by a second dielectric such that a second capacitor is formed. Finally, each of the contact member pairs are arranged relative to one another and housing collectively by a dielectric casing so as to minimize crosstalk during high frequency data transfer.

In accordance with a further aspect of the present invention is a method of inhibiting electromagnetic interference during transfer of data between electronic devices. Initially, a first electronic device is joined to a jack connector and a second electronic device is joined to a plug connector. The plug connector is inserted into the jack connector such that an electrical connection is established between the first and second electric devices. The jack connector comprises a plurality of contacts arranged sequentially and connected in a series of at least two signal pairs. A first signal pair comprises a second contact and a third contact, and a second signal pair comprises a first contact and a fourth contact. Each of the first and third contacts mounts a plate-like extension oriented in a first direction and in respective planes generally parallel to one another. Each pair of extensions are separated by a first dielectric such that a first capacitor is formed. Similarly, each of the second and fourth contacts mounts a plate-like extension oriented in a second direction and also in respective planes generally parallel to one another. Each pair of extensions are likewise separated by a second dielectric such that a second capacitor is formed. Also, each contact of each contact pair has a plug engaging portion and a board engaging portion, the plurality of contacts having a selected shape, being arranged relative to one another, and being housed collectively by a dielectric casing so as to minimize crosstalk during data transfer.

In accordance with yet another aspect of the present invention is a method of assembling an electric connector for data transfer applications. First, at least four elongate contact members are connected in at least two signal pairs. A second one of the contact members is paired with a third one of the contact members to form a first signal pair. A first one of the contact members is paired with a fourth one of the contact members to form a second signal pair. Such pairing is done such that one contact member of each contact member pair is configured differently from the other contact member of the pair, the respective contact members being oriented relative to one another such that they substantially remain in generally parallel planes, but define non-parallel paths. Such pairing is also done such that one member of each signal pair crosses over the other member of the pair so that the positions occupied by the respective members along their non-parallel paths are reversed. Next, a plate-like extension is mounted to each of the first and third contact members. Each plate-like extension is oriented in a first direction and in respective planes generally parallel to one another, and each pair of extensions are separated by a first dielectric such that a first capacitor is formed. Thereafter, a plate-like extension is mounted to each of the second and fourth contact members. Each plate-like extension is oriented in a second direction and in respective planes generally parallel to one another, and each pair of extensions are separated by a second dielectric such that a second capacitor is formed. Finally, a plug engaging portion and a board engaging portion is formed on each contact member pair, the plurality of contact members having a selected shape, being arranged relative to one another, and being housed collectively by a dielectric casing so as to minimize crosstalk during high frequency data transfer.

According to a further aspect of the present invention, a method is provided for assembling a electric connector for data transfer applications. Initially, at least eight elongate contact members are connected in a series of four signal pairs. A fourth one of the contact members is paired with a fifth one of the contact members so as to form a first signal pair. A second signal pair is formed of a third one of the contact members and a sixth one of the contact members. Then, a first one of the contact members and a second one of the contact members are formed in a third signal pair. Finally, a seventh one of the contact members and an eighth one of the contact members are arranged to form a fourth signal pair. One contact member of each contact member pair is configured differently from the other member of the pair, the respective members being oriented relative to one another such that they substantially remain in generally parallel planes, but define non-parallel paths. Also, one contact member of each of the first, third and fourth signal pairs crosses over the other contact member of the pair such that the positions occupied by the respective contact members along their non-parallel paths are reversed. Each of the third and fifth contact members mounts a plate-like extension oriented in a first direction and in respective planes generally parallel to one another. Each pair of extensions are separated by a first dielectric such that a first capacitor is formed. Furthermore, each of the fourth and sixth contact members mounts a plate-like extension oriented in a second direction and also in respective planes generally parallel to one another. Each pair of extensions are likewise separated by a second dielectric such that a second capacitor is formed. Finally, each contact member of each contact member pair has a plug engaging portion and a board engaging portion, the plurality of contact members having a selected shape, being arranged relative to one another, and being housed collectively by a dielectric casing so as to minimize crosstalk during high frequency data transfer.

In accordance with still another aspect of the present invention are a plurality of at least four elongate contact members including wires arranged sequentially and connected in a series of signal pairs for use in a jack connector for high performance data transfer. A first signal pair comprises a first elongate contact member and a third elongate contact member. The first and third contact members each mount a plate-like extension oriented in a first direction and in respective planes generally parallel to one another. Each pair of extensions are separated by a first dielectric having a relatively high dielectric value such that a first high gain capacitor for minimizing crosstalk is formed. A second signal pair comprises a second elongate contact member and a fourth elongate contact member. The second and fourth contact members each mount a plate-like extension oriented in a second direction and in respective planes generally parallel to one another. Each pair of extensions are also separated by a second dielectric having a relatively high dielectric value such that a second high gain capacitor for minimizing crosstalk is formed.

According to yet another aspect of the present invention, an electric connector for high performance data transfer comprises a plurality of elongate contact member pairs. Generally flat plate capacitors are positioned within alternating members of at least two of the contact member pairs so as to enhance crosstalk reduction during data transfer.

BRIEF DESCRIPTION OF THE DRAWINGS

The same numerals are used throughout the figure drawings, set forth below, to designate similar elements. Still other objects and advantages of the present invention will become apparent from the detailed description of the preferred embodiments to follow.

DETAILED DESCRIPTION OF THE PREFERRED EMBODIMENTS

Figure 1:
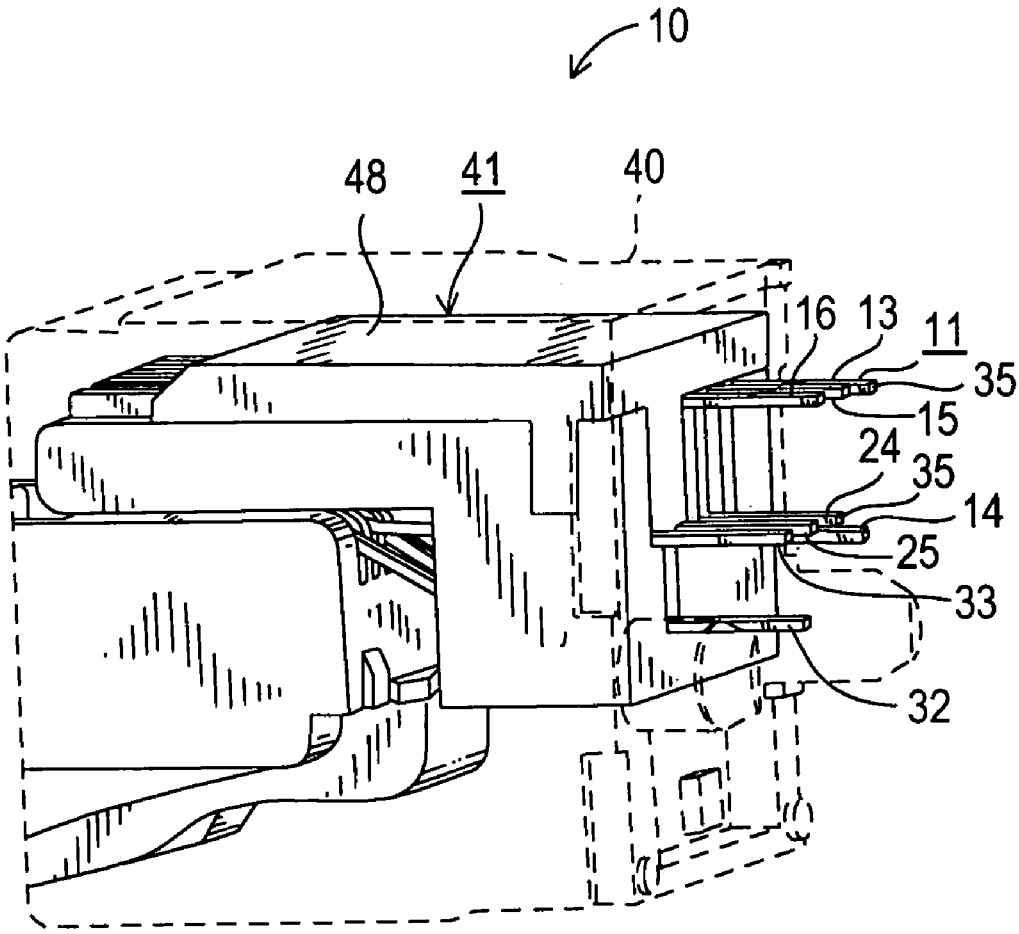
FIG. 1 is a perspective view of a high performance, high capacitance gain, connector jack for enhancing data transfer, in accordance with one aspect of the present invention.
Figure 2:
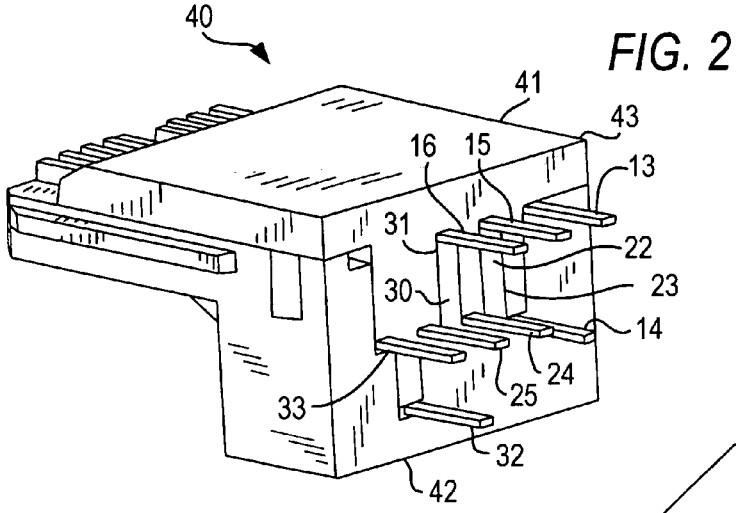
FIG. 2 is a perspective view of a contact locating sub-assembly for a jack according to the assembly shown in FIG. 1.
Figure 3:
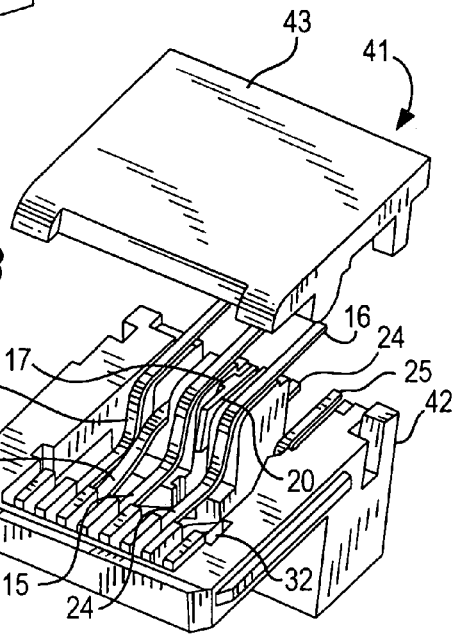
FIG. 3 is a perspective view of the sub-assembly shown in FIG. 2 showing a lid portion of the sub-assembly removed from the base portion.
Figure 4:
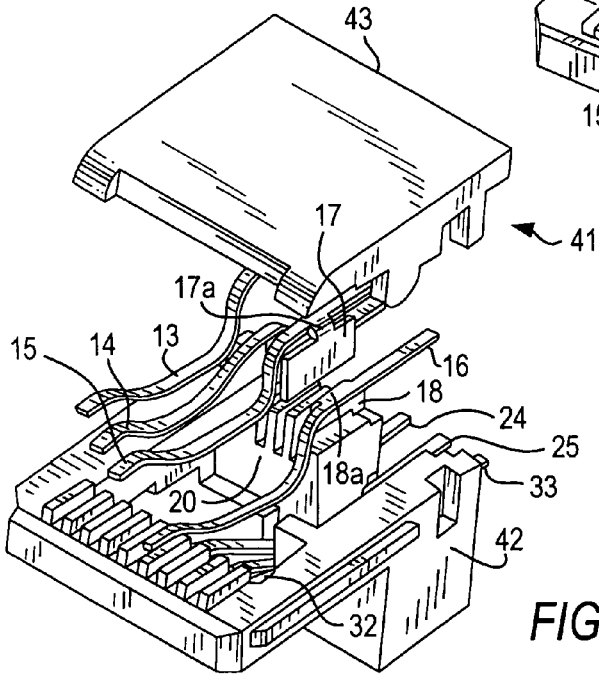
FIG. 4 is an exploded perspective view of the sub-assembly shown in FIG. 2.

Referring now to the drawings, and more particularly to FIGS. 1–30, there is shown a specific, illustrative electric connector jack 1 for data transfer applications or the like, in accordance with the present invention. According to the embodiment shown in FIGS. 1–11, the assembly includes a jack connector 10 comprising a plurality of contacts 11, preferably at least eight, arranged in sequential positions designated P1 to P8. These contacts are desirably connected in at least four signal pairs, each pair forming part of a respective signal current. By convention, the fourth contact 24 (i.e., the contact occupying position P4) and fifth contact 16 are in a first signal pair, third contact 15 and sixth contact 25 comprise a second signal pair, first contact 13 and second contact 14 are in a third signal pair and seventh contact 32 and eighth contact 33 constitute a fourth signal pair.

The contacts are preferably elongate members formed of a highly electrically conductive material, e.g., commercially pure copper, and are formed so as to be situated in corresponding sequential planes, one next to the other, the planes being substantially parallel to one another. One contact of each contact pair is configured differently from the other contact of the pair. The respective contacts in each contact pair are also oriented relative to one another such that they remain in generally parallel planes, but define non-parallel paths. Alternatively or concurrently, the contacts in each contact pair overlap at least once for added crosstalk inhibition.

Although the present invention has been shown and described with reference to a jack connector with eight conductive contacts operatively engaged in four signal pairs, it will be understood that other numbers of contacts and/or signal pairs, and electric or electronic connector arrangements, maybe utilized, giving consideration to the purpose for which the present invention is intended.

Figure 6:
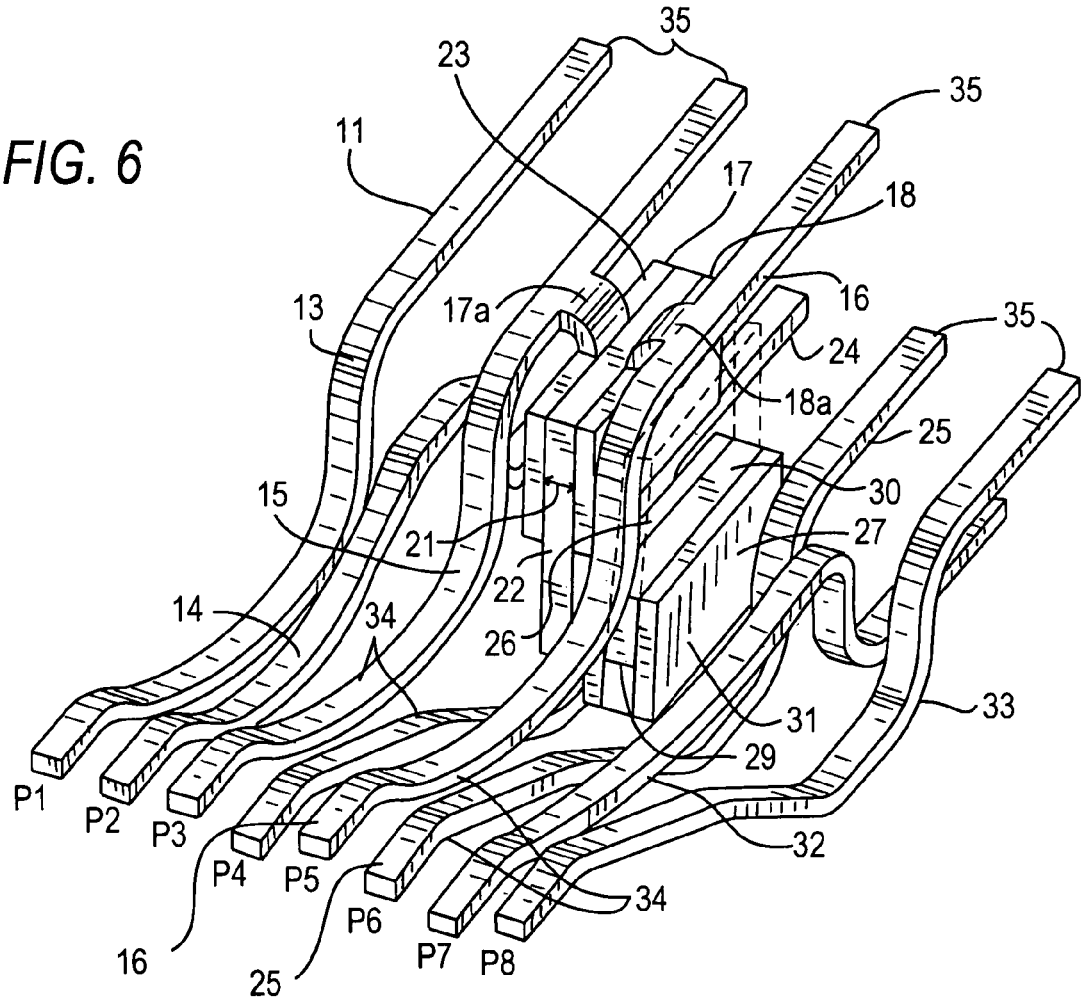
FIG. 6 is a perspective view of a contact and capacitor configuration formed by the sub-assembly shown in FIG. 2.
Figure 7:
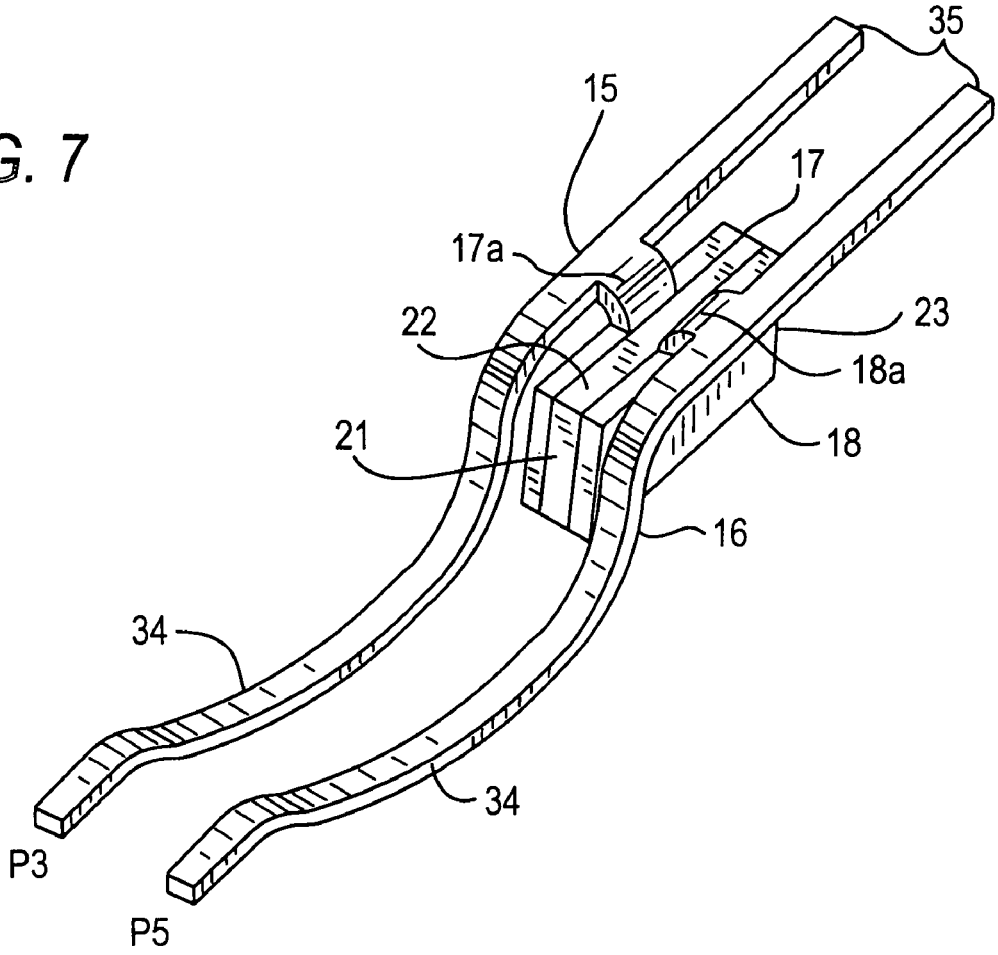
FIG. 7 is a perspective view of a first capacitor formed from plate-like extensions mounted on third and fifth contacts of a first contact pair, according to one aspect of the present invention.
Figure 8:
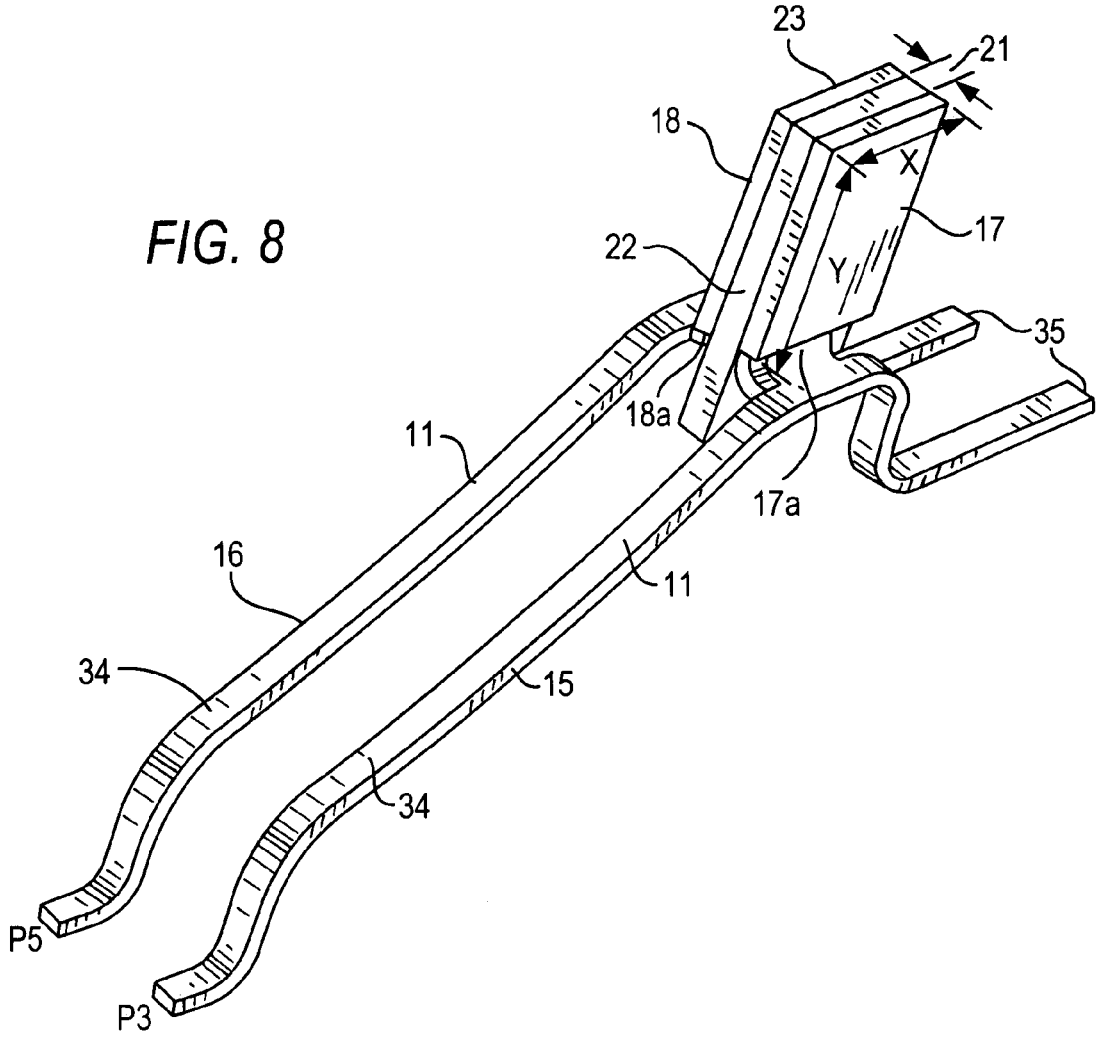
FIG. 8 is a perspective view of a first capacitor formed from plate-like extensions mounted on third and fifth contacts of a first contact pair, according to another aspect of the present invention.

In accordance with the invention, as illustrated in FIGS. 6–8, the third contact 15 of the second signal pair and the fifth contact 16 of the first signal pair each mounts, by means of a connection portion 17*a*, 18*a*, a plate-like extension 17, 18, respectively, oriented in a first direction, preferably downwardly from the respective contacts, as shown in FIG. 7, and in respective planes generally parallel to one another. The extensions are separated a selected distance 21, e.g., about 15 mils to about 17 mils, by a first dielectric 22, e.g., a dielectric polymeric material, air or like gas having dielectric properties, located between them, such that a first capacitor 23 is formed. In the illustrated embodiment wherein the extensions have flat plate configurations, the resulting arrangement is a flat-plate capacitor.

Figure 9:
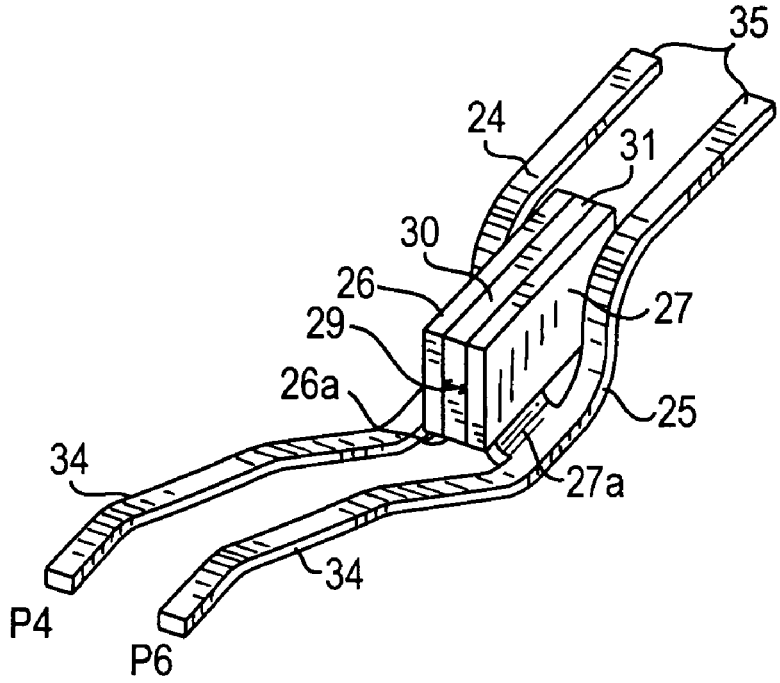
FIG. 9 is a perspective view of a second capacitor formed from plate-like extensions mounted on fourth and sixth contacts of a second contact pair, according to one aspect of the present invention.
Figure 10:
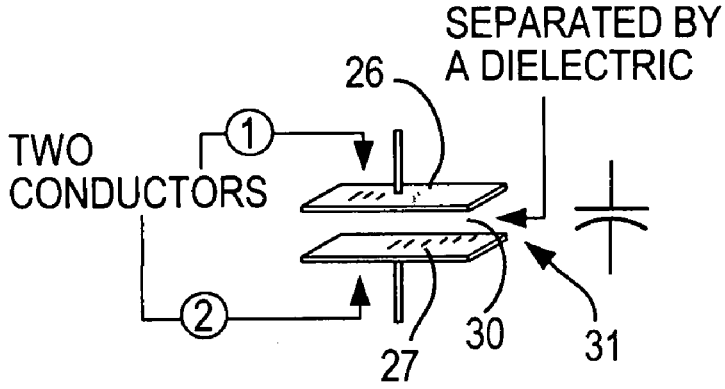
FIG. 10 is a schematic diagram showing a flat plate capacitor, according to one aspect of the present invention.

Similarly, as best seen in FIG. 9, each of the fourth contact 24 of the first signal pair and sixth contact 25 of the second signal pair mounts, by means of a connection portion 26*a*, 27*a*, a plate-like extension 26, 27, respectively, oriented in a second direction, preferably upwardly from the mounting point on the contacts, also in respective planes generally parallel to one another. The extensions are likewise separated a distance 29, e.g., about 15 mils to about 17 mils, by a second dielectric 30, such as a dielectric polymeric material, air or like gas having dielectric properties, such that a second capacitor 31 also of a flat-plate type is formed. A capacitor of this general description is illustrated schematically in FIG. 10.

Alternatively or concurrently, the plate-like extensions of the third and fifth contacts and/or the fourth and sixth contacts, respectively, sandwich a dielectric insert or a plurality of dielectric inserts. According to a further embodiment, the respective dielectrics 22, 30 of each contact pair are included in the sandwich of one or more dielectric inserts. In this manner, the housing and the inserts may advantageously be constructed of different dielectric materials, within the spirit and scope of the present invention. Other variations of this arrangement will be appreciated based upon a review of this disclosure.

Figure 5:
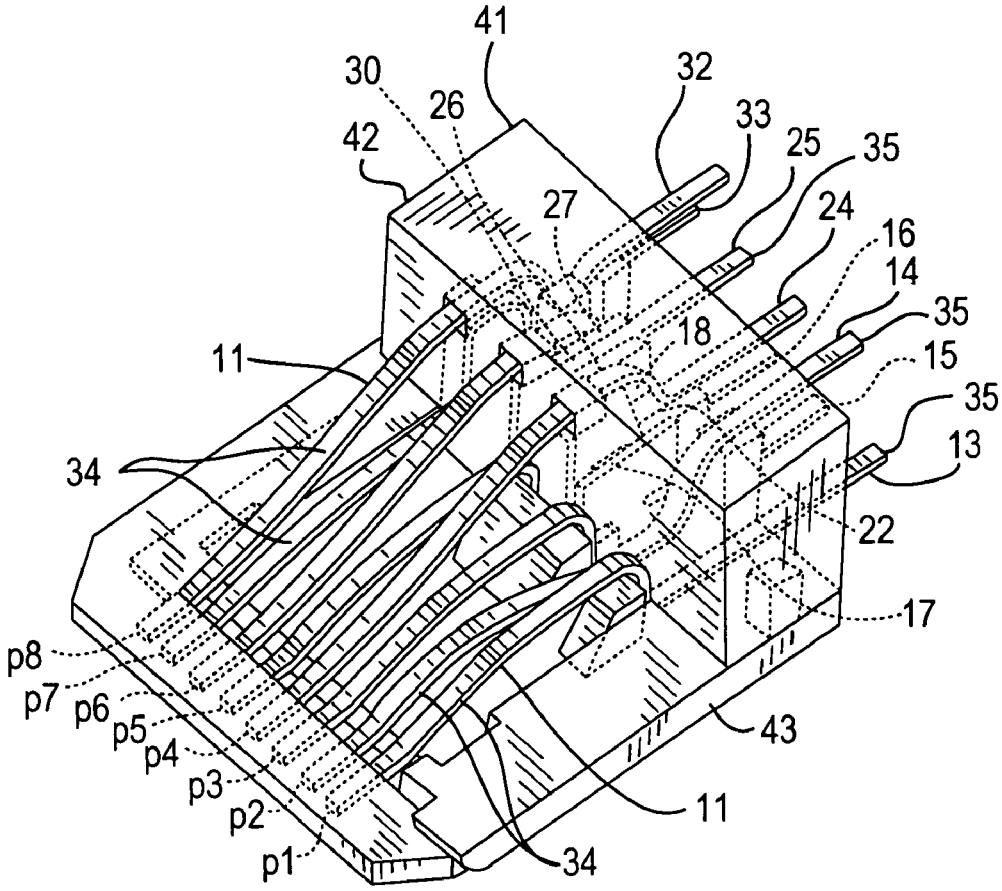
FIG. 5 is an inverted perspective view of the contact locating sub-assembly shown in FIG. 2.

As shown in FIG. 5, each contact of each signal pair has a plug engaging portion 34 and a board engaging portion 35. The plurality of contacts have a selected shape, are arranged suitably relative to one another, and are housed collectively by a dielectric housing 40 (best seen in FIGS. 1 and 11) so as to minimize crosstalk during data transfer, especially during high frequency data communications.

In a further embodiment, one of capacitors 23, 31 is a flat plate capacitor and the other capacitor is of a non-flat plate type. Alternatively, both are non-flat plate type capacitors but are adapted for high capacitance gain production for optimal, passive, electromagnetic interference inhibiting effect. It is additionally preferred that each contact and its plate-like extension be constructed, e.g., stamped or cast, either as a one piece unit, as a relatively flat assembly, as a rounded or wire-like assembly, e.g., extruded, and/or in any combination thereof. Also alternatively or concurrently, each contact and associated extension may be formed as separate pieces which are subsequently joined to one another suitably by conventional welding, soldering, cold or hot rolling techniques and/or using an adhesive.

According to another aspect of the present invention, the total surface area of the extensions of the first capacitor is generally unequal to that of the second capacitor. More particularly, in one embodiment, the surface area of the first capacitor extensions is less than that of the second capacitor extensions. In another embodiment, the first capacitor extensions have a surface area greater than that of the second capacitor extensions. Furthermore, the surface area of the first capacitor extensions may be generally equivalent to that of the second capacitor extensions, within the spirit and scope of the present invention.

Generally speaking, capacitance gain may be controlled by a variety of factors including, but not limited to, the spacing of the extensions forming each capacitor from one another, their dimensions, their surface texture, the nature of the dielectric material located in the space between them, and the orientation of the extensions relative to one another. The plate dimensions, the dielectric nature of the material between them, and the relative orientation of the plates are directly proportional to the compensating contact plate capacitance, whereas the distance of separation between the plates is inversely proportional thereto. For optimal design, and according to one aspect of the present invention, such proportionality is determined by the following mathematical relationship:

$$c=22.49e^{-5}((\in_r xy)/s)$$

where c=capacitance in pf, $\in_r$=relative dielectric constant of the dielectric material between the plates, x=plate width in mils, y=plate length in mils and s=plate separation distance in mils. The foregoing is considered applicable to a pair of contacts constituting a particular signal pair, each having a plate-like extensions oriented generally parallel to one another, according to various aspects of the present invention.

EXAMPLE

To achieve a selected capacitance, in accordance with the present invention, extension plates are used where x=100 mils, y=140 mils and s=17 mils. The plate-like extensions are positioned generally parallel to one another and a Valox® 553 insert is located in the space between them, this material having a relative dielectric constant, $\in_r$, of about 3.7. Using the above formula, $c=22.49e^{-5}$ (((3.7)(100)(140)/(17)), the plate capacitance is calculated to be 0.685 pf.

Although the present invention has been shown and described as utilizing a conventional conductive material for the contacts, such as commercially pure copper, it is understood that operative components of this invention may be constructed of other high conductivity materials, giving consideration to the purpose for which the present invention is intended. For example, a copper alloy, silver and/or alloys thereof, aluminum and/or its alloys, fiber optic materials, and super conductors or the like may also be used, within the spirit and scope of the present invention.

In addition, while the present invention has been shown and described as utilizing plate-like surfaces, that is, surfaces with a relatively flat, even grade, it is understood that such surfaces may be polished to a mirror-like finish or, in the alternative, textured, provided that any disruption of the capacitance gain produced is negligible.

In yet another embodiment, an electric connector for data transfer applications is provided wherein the connector comprises at least four elongate contact members connected in at least two signal pairs. A first signal pair includes a second contact member 24 and a third contact member 16. A second signal pair includes a first contact member 15 and a fourth contact member 25. One member of each pair is configured differently from the other member of the pair, the respective members being oriented relative to one another such that they remain in generally parallel planes, but define non-parallel paths. Each of the first and third members mounts a plate-like extension 17, 18, respectively, oriented in a first direction and in respective planes generally parallel to one another. The extensions are spaced apart by a selected distance, each pair of extensions being separated by first dielectric 22 such that first capacitor 23 is formed. Each of the second and fourth members mounts a plate-like extension 26, 27, respectively, oriented in a second direction also in respective planes generally parallel to one another. Each pair of extensions are likewise separated, i.e., by second dielectric 30, such that second capacitor 31 is formed. Each contact member of each signal pair has plug engaging portion 34 and a board engaging portion 35, the plurality of contact members having a selected shape, being arranged relative to one another, and being housed collectively by a dielectric casing so as to minimize crosstalk during data transfer.

Generally speaking, according to one embodiment of the present invention best seen in FIGS. 1–5, the structure of housing 40 has a contact locating sub-assembly 41 which not only forms dielectrics 22, 30 between respective plate extensions, but also effectively creates the first and second capacitors. In this connection, the housing is constructed, at least in part, of a dielectric polymeric material or the like, e.g., Valox® 553, having a relatively high dielectric value.

More particularly, sub-assembly 41 includes a base portion 42 and a lid portion 48, the base portion being formed suitably for receiving each signal pair and retaining the contacts of each pair in the desired arrangement, i.e., relative to one another and the housing. Preferably, the surface of the structure is configured so as to rise and fall stepwise across its width. This rise and fall pattern forms generally rectangular steps 43 rising from the surface, i.e., where the surface rises and then falls. Where the surface falls and then rises in a rectangular-like fashion, contact receiving detents or channels 44 are formed. The detents desirably have a width suitable for receiving and snugly engaging their respective contacts and extensions thereof. Alternatively, the width is adapted for a loose fit with the respective contact and extensions, the contact being secured in the detent using a suitable adhesive or the like.

Between the respective contacts of each pair, the structure rises stepwise so as to form dielectrics 22, 30, respectively, between them. Further alternatively or concurrently, the dielectrics are formed, at least in part, by complementary mating falls 45 and rises 46 in the sub-assembly lid portion 48, best seen in FIG. 2, which is placed over the base portion-supported assembly of contacts, thereby securing the contacts within sub-assembly 41. By forming the dielectric in this fashion, crosstalk inhibiting properties of the present invention are enhanced.

Figure 12:
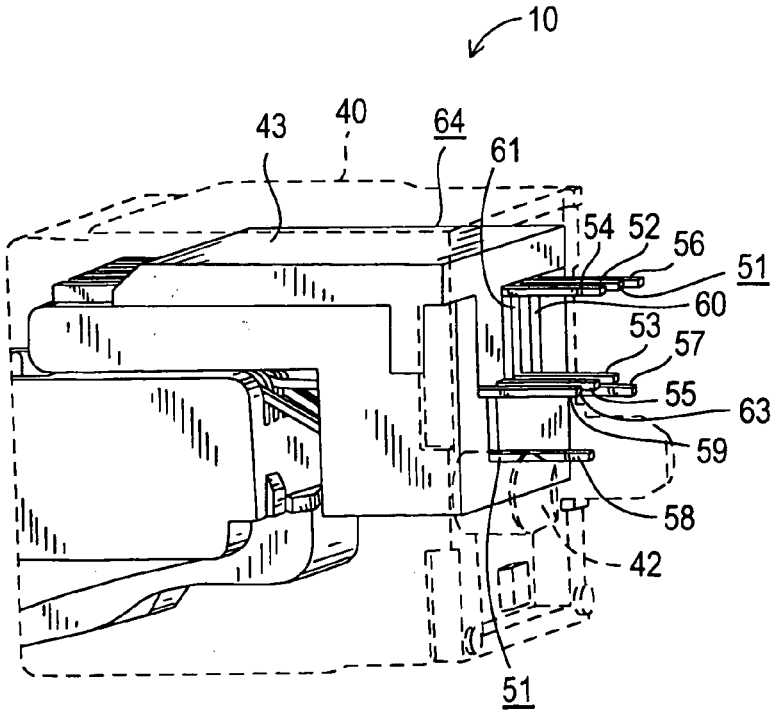
FIG. 12 is a high performance, high capacitance gain, connector jack for enhancing data transfer, in accordance with another aspect of the present invention.
Figure 13:
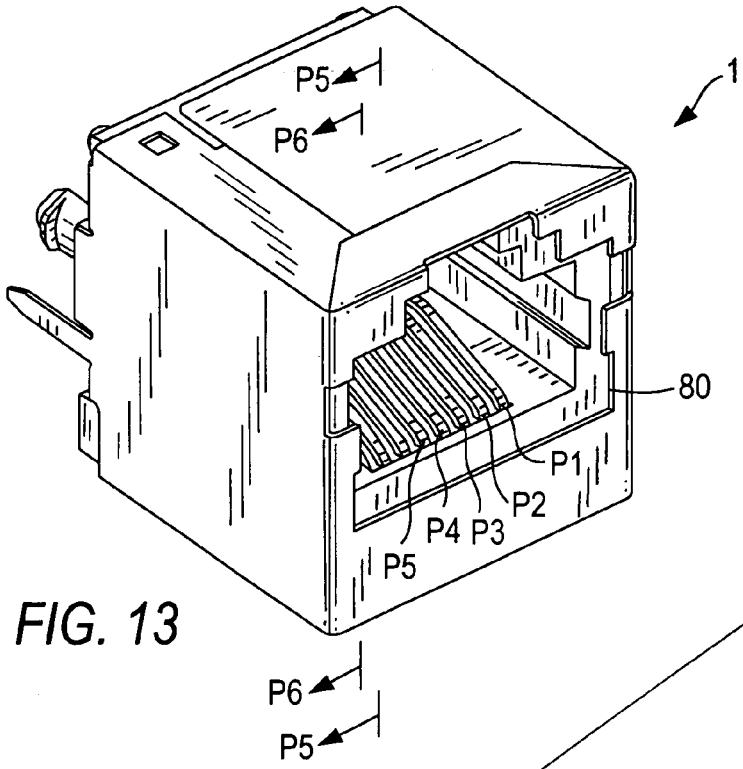
FIG. 13 is a perspective view of a high performance, high capacitance gain, connector jack for enhancing data transfer, in accordance with a further aspect of the present invention.
Figure 14:
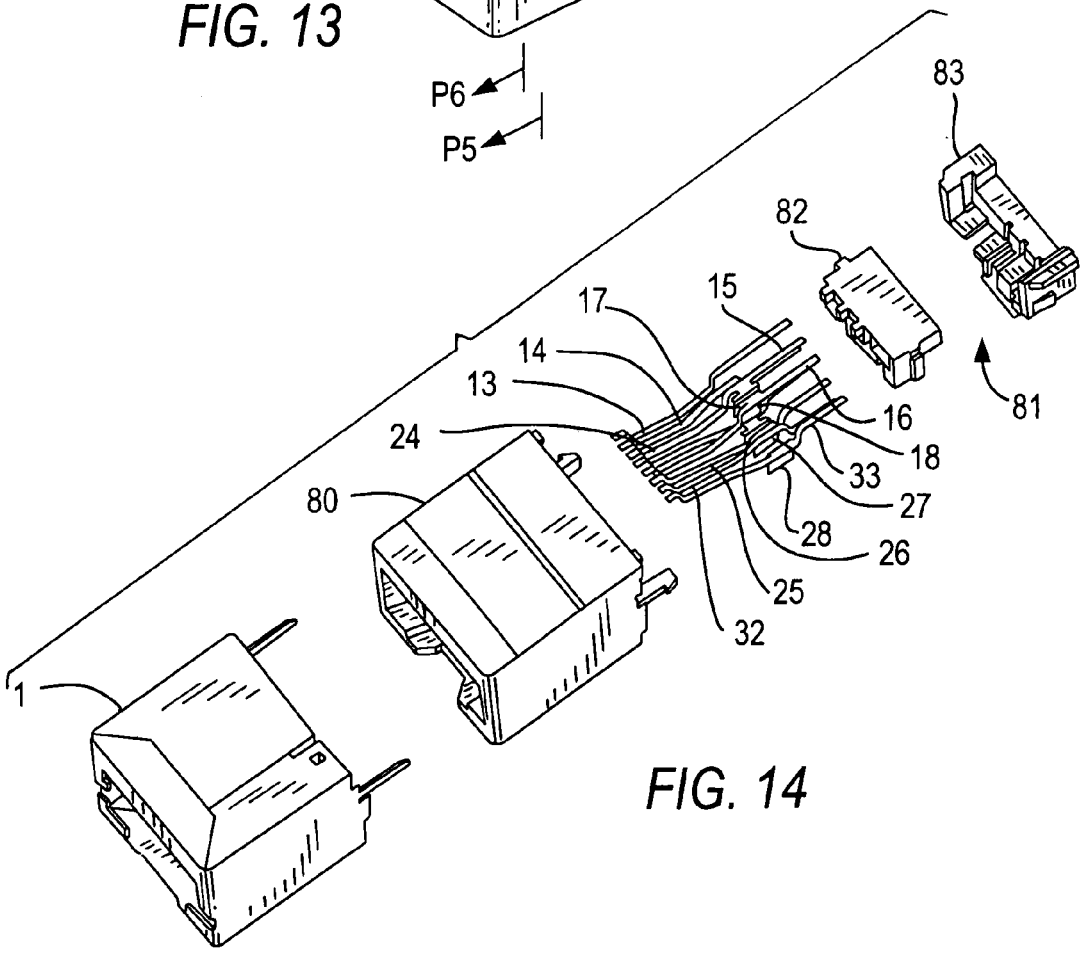
FIG. 14 is an exploded view of the jack shown in FIG. 13.
Figure 15:
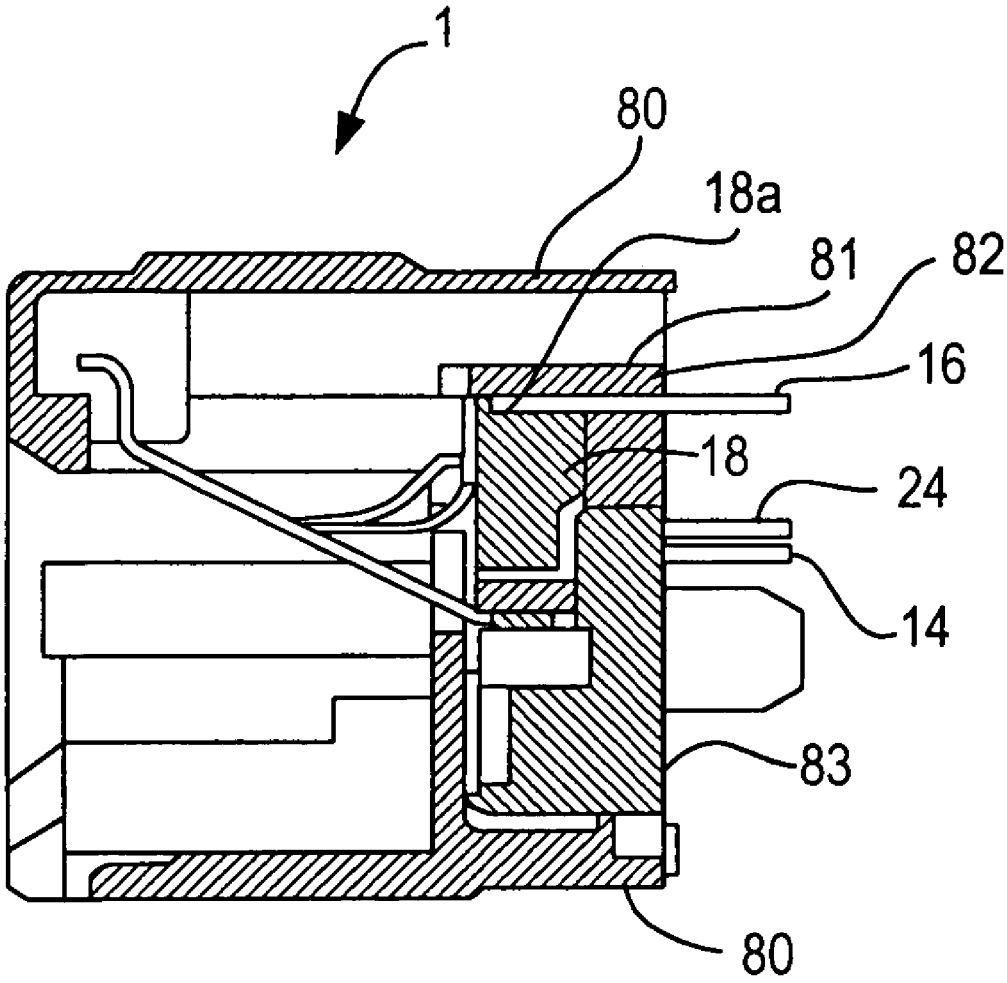
FIG. 15 is a sectional view of the jack shown in FIG. 13 taken along contact P5.
Figure 15A:
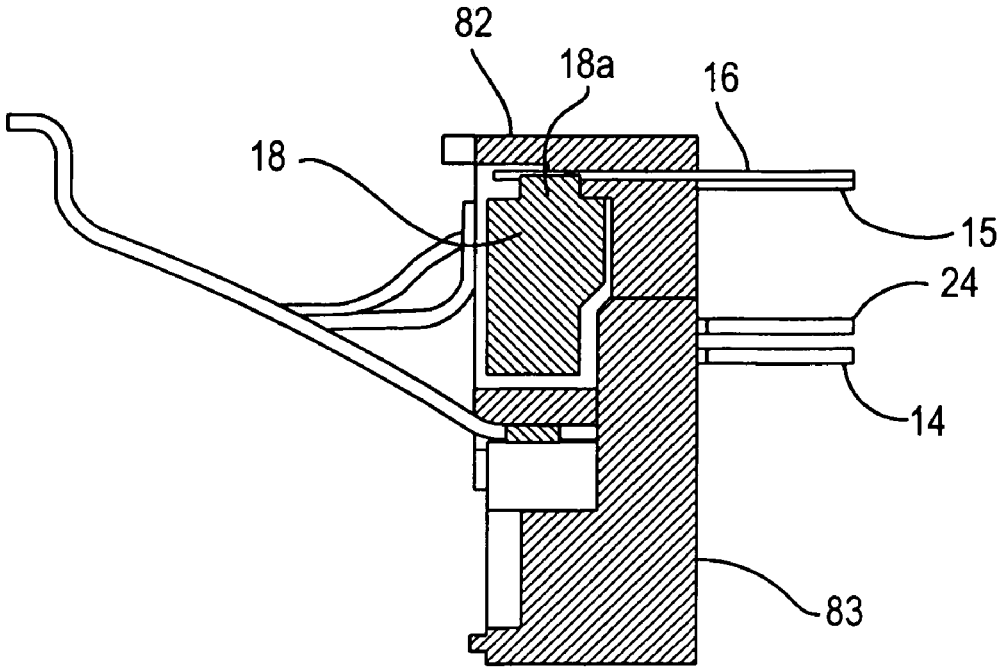
FIG. 15A is a sectional view taken along contact P5 of a contact locating sub-assembly according to the jack shown in FIG. 13.
Figure 16:
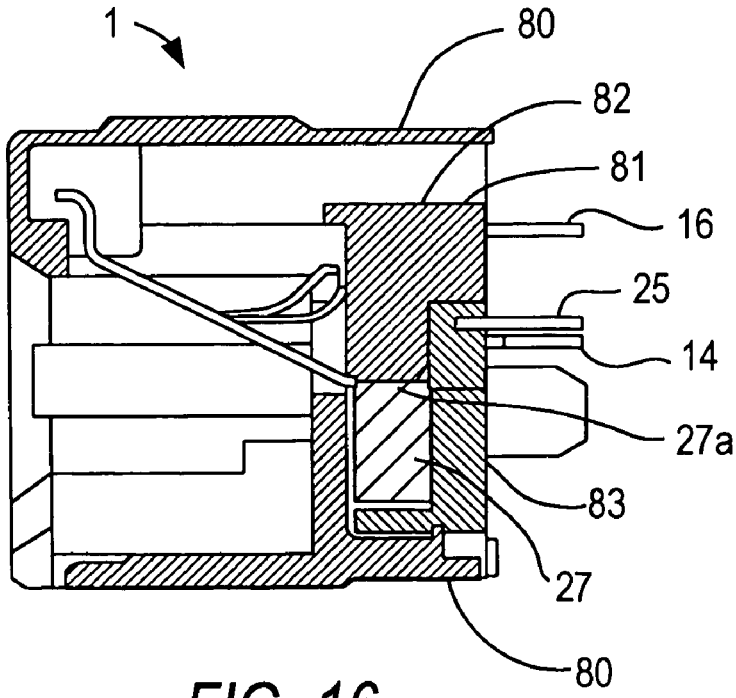
FIG. 16 is a sectional view of the jack shown in FIG. 13 taken along contact P6.
Figure 16A:
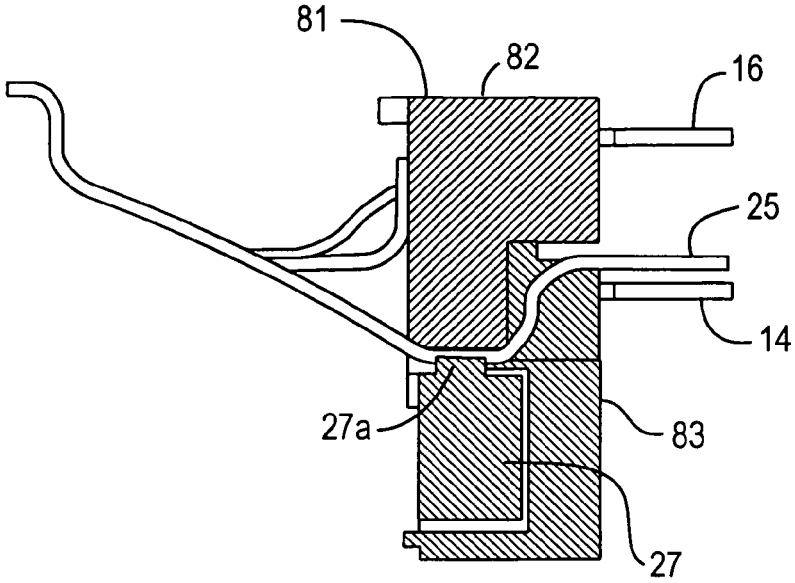
FIG. 16A is a sectional view taken along contact P6 of a contact locating sub-assembly according to the jack shown in FIG. 13.
Figure 17:
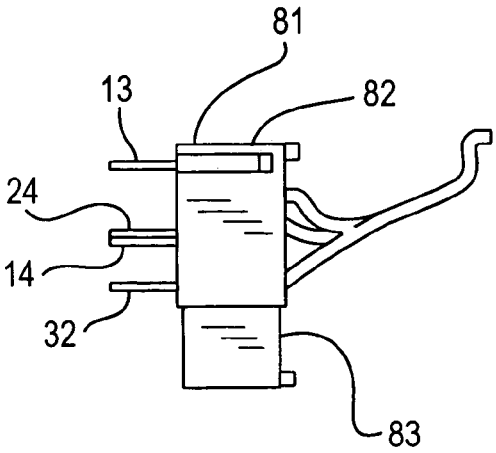
FIG. 17 is a side view of a contact locating sub-assembly according to the jack shown in FIG. 13.
Figure 18:
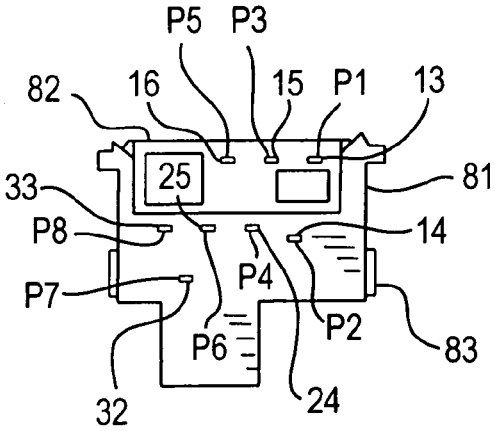
FIG. 18 is a front view of the sub-assembly shown in FIG. 17.

Referring now to another aspect of the present invention, a high performance, high capacitance gain jack connector 50 is provided for high frequency data transfer applications or the like. As shown in FIG. 12, a plurality of elongate contact members 51 consist of at least eight wires arranged in sequential positions and connected in a series of four signal pairs. The first signal pair comprises a fourth wire 53 paired with a fifth wire 54. A third wire 52 and a sixth wire 55 comprise a second signal pair. First wire 56 and second wire 57 are in a third signal pair and seventh wire 58 and eighth wire 59 constitute a fourth signal pair. The third and fifth wires each mount plate-like extensions (not shown) oriented in a first direction and in respective planes generally parallel to one another. The extensions are separated a selected distance by a first dielectric 60, e.g., a portion of the housing, an insert or the like, having a relatively high dielectric value, such that a first high gain capacitor for minimizing crosstalk is formed.

Likewise, the second and fourth wires each mount a plate-like extension (not shown) oriented in a second direction, e.g., generally opposite to that of the first direction, and in respective planes generally parallel to one another. Similarly, these extensions are separated selected distances by a second dielectric 61 having a relatively high dielectric value such that a second high gain, flat plate capacitor for minimizing crosstalk is formed.

Finally, each wire has a plug engaging portion 62, e.g., of a conventional type (not shown), and a board engaging portion 63. The wires also have a selected shape, are arranged relative to one another, and are housed collectively by a dielectric casing 64 so as to minimize crosstalk during high frequency data transfer.

Figure 11:
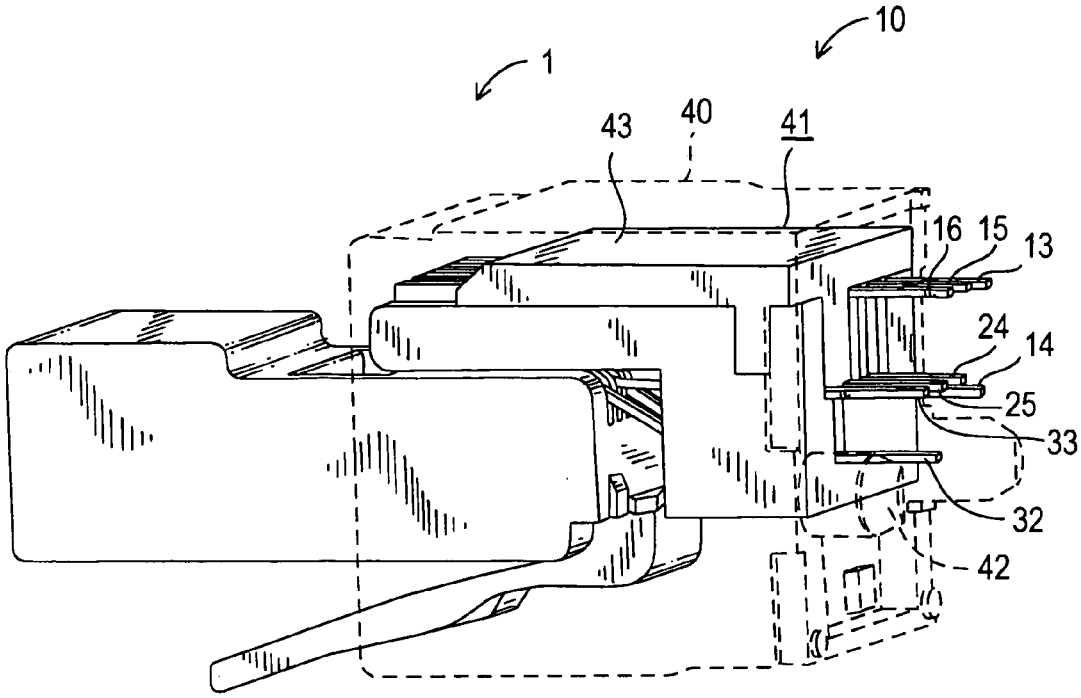
FIG. 11 is a perspective view of the connector jack shown in FIG. 1 illustrating a plug engaged with the jack.

Alternatively or concurrently, at least one of the elongate contact members, illustrated in FIGS. 1 and 11, includes a wire. In one embodiment, each member includes at least one wire-like portion that is relatively circular in diameter, generally oval in diameter, or in any combination thereof. In addition, such wire-like portions are optionally formed of sections having increased diameter, reduced diameter and/or relatively flattened portions suitable for accommodating corresponding geometry of the dielectric housing, in accordance with the present invention.

Turning now to another alternative embodiment of the present invention, as shown in FIGS. 13–21, a dielectric housing 80 is provided having a sub-assembly 81 is constructed in upper and lower contact receiving parts 82, 83, respectively. Each part is formed suitably for receiving corresponding signal pairs and retaining the contacts of each pair in the desired arrangement, i.e., relative to one another and the housing. As with the prior embodiments, the fourth contact 24 and fifth contact 16 are in a first signal pair, third contact 15 and sixth contact 25 comprise a second signal pair, first contact 13 and second contact 14 are in a third signal pair and seventh contact 32 and eighth contact 33 constitute a fourth signal pair.

More particularly, the upper part 82 is configured for receiving the first contact 13, second contact 14, third contact 15 and fourth contact 24. The lower part 83 is formed suitably for receiving the fifth contact 16, sixth contact 25, seventh contact 32 and eighth contact 33. Upon engagement of the first part with the second part, e.g., by friction fit, snap engagement or the like, the first through eighth contacts are located in their respective positions P1 through P8.

Figure 19:
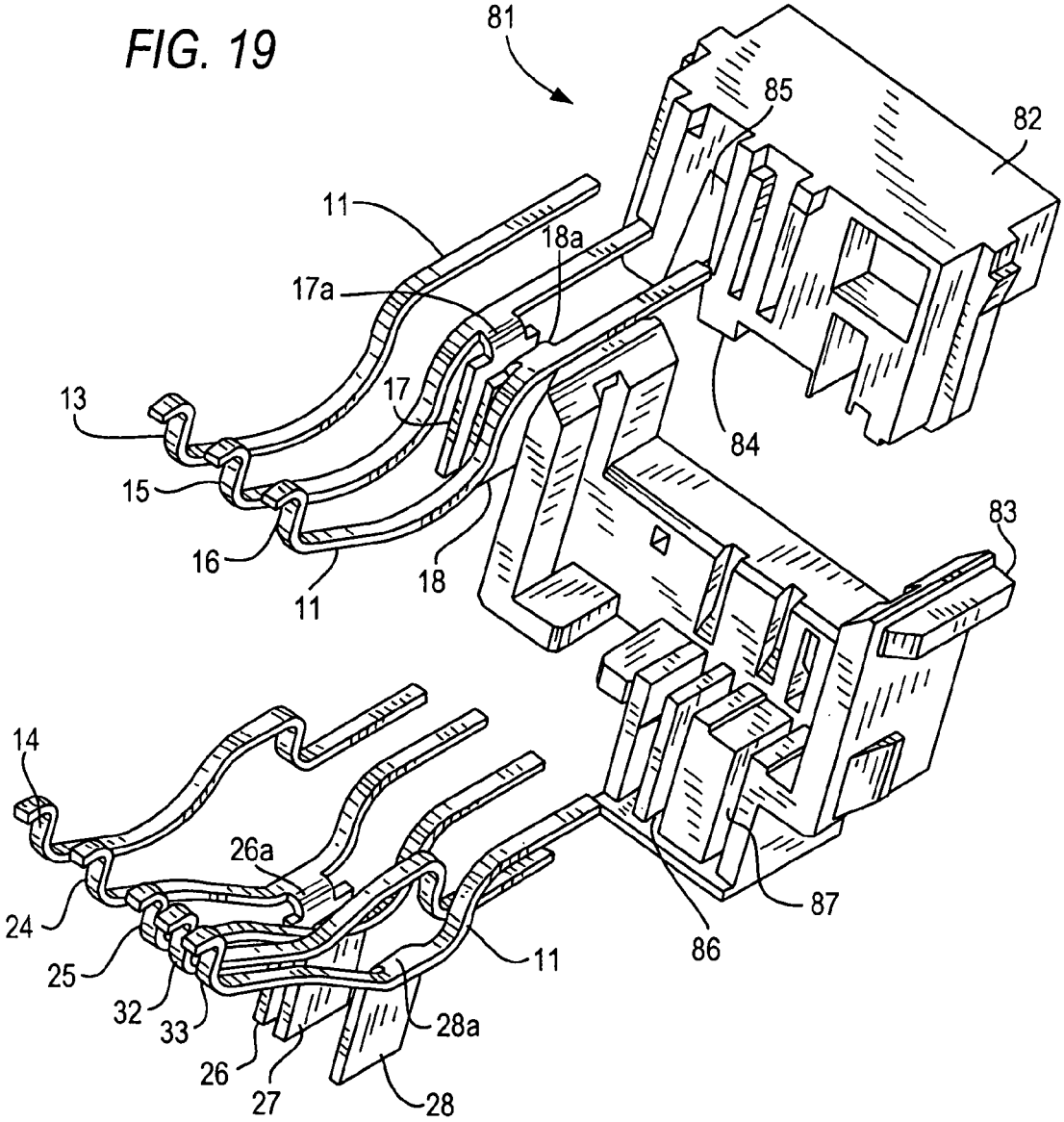
FIG. 19 is an exploded view of connector housing portions and contacts shown in FIG. 13.
Figure 20:
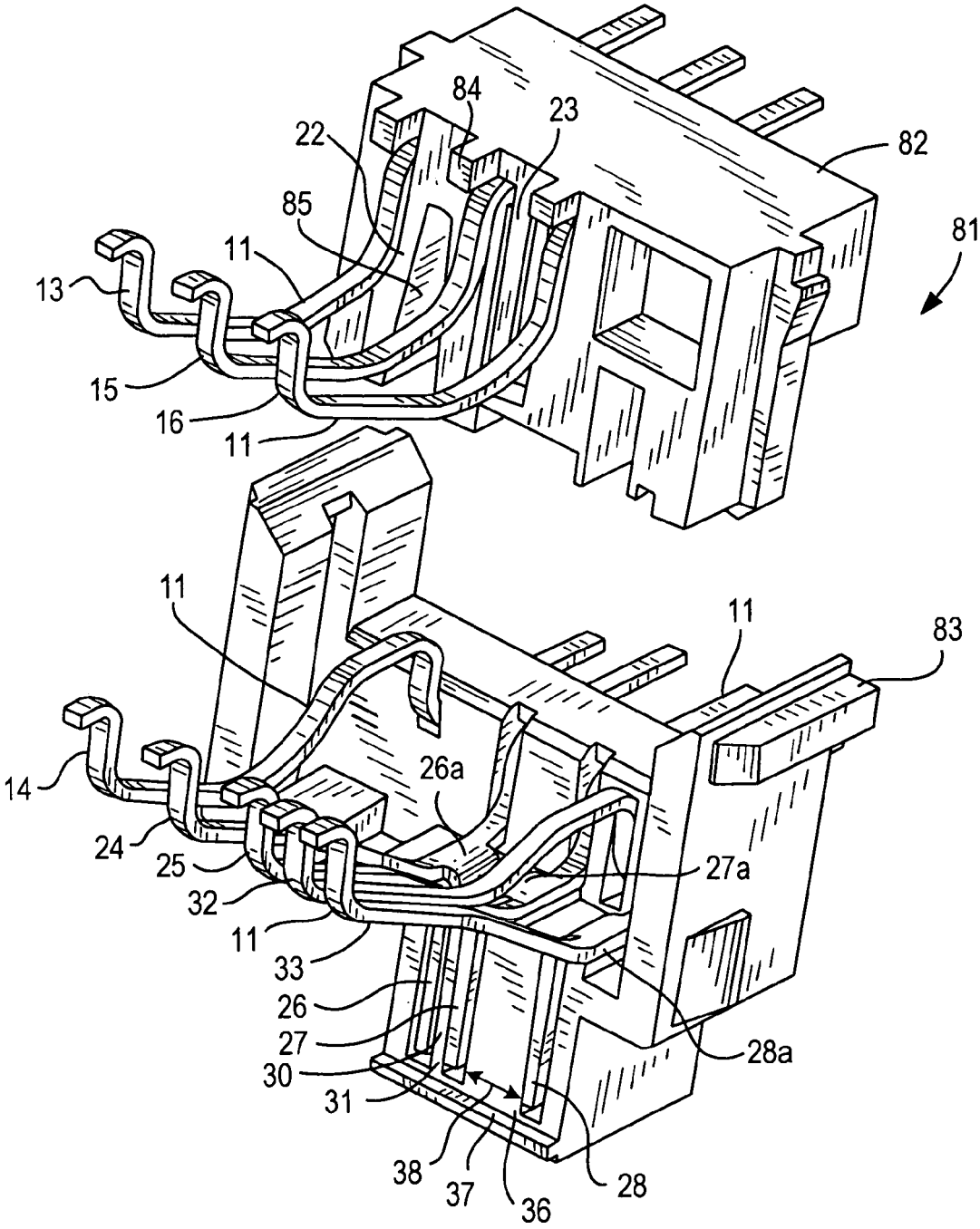
FIG. 20 is a perspective view of the connector housing portions and contacts shown in FIG. 19, in a partially assembled condition.
Figure 21:
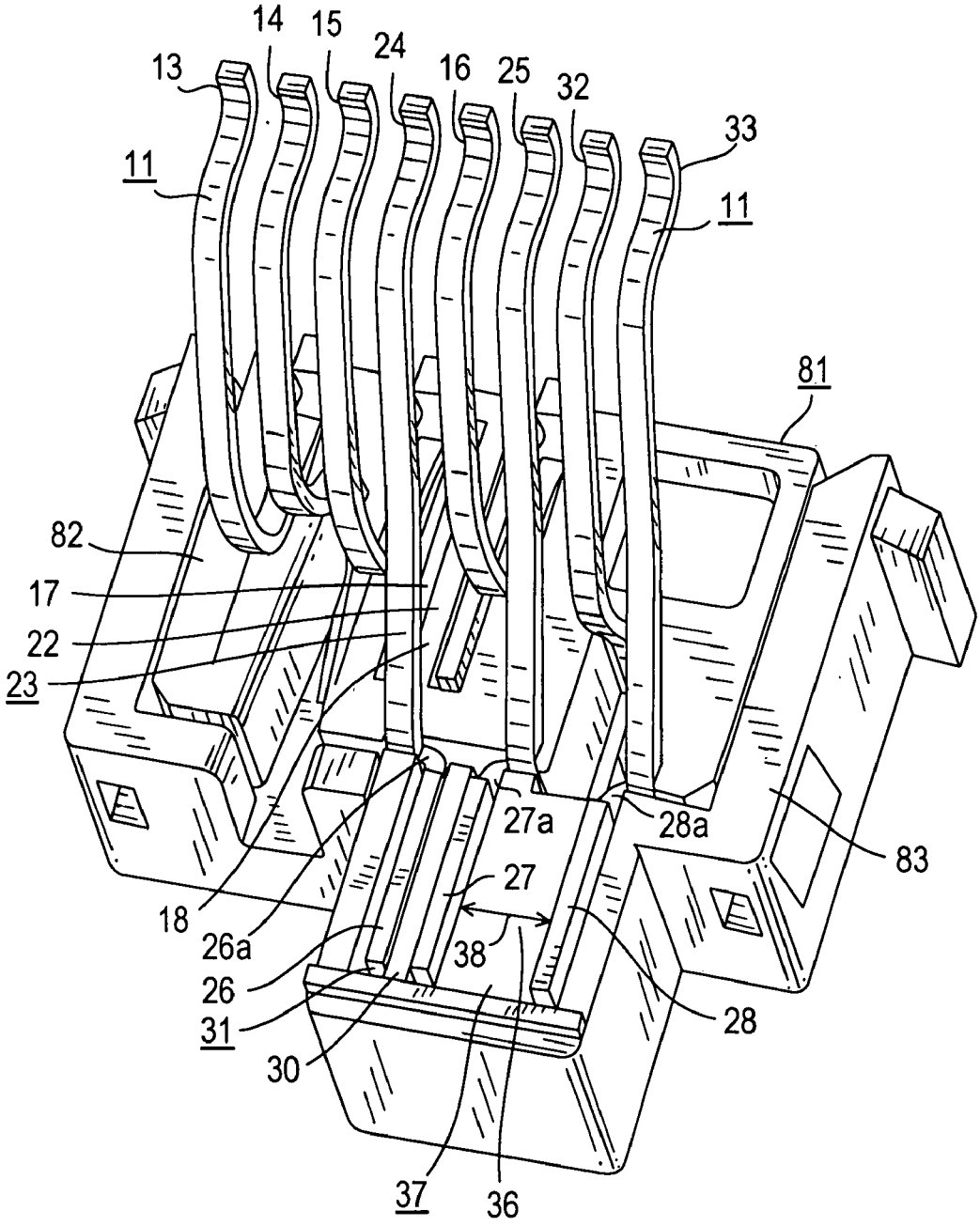
FIG. 21 is a perspective view of the connector housing portions and contacts shown in FIG. 19, in a fully assembled condition.

As illustrated in FIGS. 19–21, the third contact 15 of the second signal pair and the fifth contact 16 of the first signal pair each mounts, by means of connection portions 17*a*, 18*a*, a plate-like extension 17, 18, respectively, oriented in a first direction, preferably downwardly from the respective contacts, and in respective planes generally parallel to one another. The extensions are separated a selected distance, e.g., about 15 mils to about 17 mils, by first dielectric 22, e.g., a dielectric polymeric material, air or like gas having dielectric properties, located between them, such that first capacitor 23 is formed. In the illustrated embodiment wherein the extensions have flat plate configurations, the resulting arrangement is a flat-plate capacitor.

Similarly, each of the fourth contact 24 of the first signal pair and sixth contact 25 of the second signal pair mounts, by means of connection portions 26*a*, 27*a*, the plate-like extension 26, 27, respectively, oriented in a second direction, preferably downwardly from the mounting point on the contacts, also in respective planes generally parallel to one another. The extensions are likewise separated a distance, e.g., about 15 mils to about 17 mils, by second dielectric 30, such as a dielectric polymeric material, air or like gas having dielectric properties, such that second capacitor 31 is formed.

Alternatively, or in addition to the arrangement discussed above, the eighth contact 33 mounts, by means of connection portion 28*a*, a plate-like extension 28 oriented in a third direction. The third direction is preferably directed downwardly from the mounting point on the contact and in a plane generally parallel to that of plate-like extension 27. Extensions 27 and 28 are separated a selected distance 38 by a third dielectric 36, such as a dielectric polymeric material, air or like gas having dielectric properties, such that third capacitor 37 is formed.

Preferably, the surface of the structure is configured, as with the other embodiments described herein, so as to rise and fall stepwise across its width. This rise and fall pattern forms generally rectangular steps 84 rising from the surface, i.e., where the surface rises and then falls. Where the surface falls and then rises in a rectangular-like fashion, contact receiving detents or channels 85 are formed. The detents desirably have a width suitable for receiving and snugly engaging their respective contacts and extensions thereof. Alternatively, the width is adapted for a loose fit with the respective contact and extensions, the contact being secured in the detent using a suitable adhesive or the like.

Between the respective contacts of each pair, the structure rises stepwise so as to form dielectrics 22, 30, 36, respectively, between them. Further alternatively or concurrently, the dielectrics are formed, at least in part, by complementary mating falls 86 and rises 87 in the sub-assembly lower portion 83 which is placed over the base portion-supported assembly of contacts, thereby securing the contacts within sub-assembly 81, as shown in FIG. 21. By forming the dielectric in this fashion, crosstalk inhibiting properties of the present invention are enhanced.

Still a further embodiment of the present invention is shown in FIGS. 22–30. According to this embodiment, there is provided a high performance, high capacitance gain, electric connector for data transfer applications, which also comprises at least eight sequentially positioned contacts connected in a plurality of signal pairs. A first signal pair includes a fourth contact 24 and a fifth contact 16. A second signal pair includes a third contact 15 and a sixth contact 25. A third signal pair comprises a first contact 13 and a second contact 14. Similarly, a seventh contact 32 and an eighth contact 33 are in a fourth signal pair.

It is preferred that one contact of each pair be configured differently from the other contact of the pair, and that the respective contacts be oriented relative to one another such that they substantially remain in generally parallel planes, but define non-parallel paths. Also, as best seen in FIGS. 22–25, one contact of each of the first, third and fourth signal pairs desirably crosses over the other contact of the pair such that the positions occupied by the respective contacts along their non-parallel paths are substantially reversed. Taken in combination with the various contact configurations of the present invention, such a cross over arrangement has been found particularly effective at further enhancing the crosstalk inhibiting characteristics of connectors set forth herein.

As illustrated in FIGS. 22–26D, the third contact 15 of the second signal pair and the fifth contact 16 of the first signal pair again each mounts, by means of a connection portion 17*a*, 18*a*, a plate-like extension 17, 18, respectively, oriented in a first direction, preferably downwardly from the respective contacts, and in respective planes generally parallel to one another. The extensions are separated at selected distance 21, e.g., about 15 mils to about 17 mils, by first dielectric 22 such that a first capacitor 23 is formed.

Similarly, as best seen in FIGS. 22–25 and 27–27D, each of the fourth contact 24 of the first signal pair and sixth contact 25 of the second signal pair mounts, by means of connection portions 26*a*, 27*a*, the plate-like extension 26, 27, respectively, oriented in a second direction, preferably a direction substantially the same as the first direction, from the mounting point on the contacts, also in respective planes generally parallel to one another. Alternatively, the second direction is generally opposite that of the first direction, i.e., in an upward direction. Further alternatively, it is desired that both the first and second directions be generally upward. The extensions are likewise separated distance 29, e.g., about 15 mils to about 17 mils, by the second dielectric 30 such that a second capacitor 31 is formed.

Also alternatively or concurrently, the plate-like extensions of the third and fifth contacts and/or the fourth and sixth contacts, respectively, sandwich a dielectric insert or a plurality of dielectric inserts. In yet another embodiment, the respective dielectrics 22, 30 of each contact pair are included in the sandwich of one or more dielectric inserts.

As shown generally in FIGS. 22–29, each contact of each signal pair is provided with plug engaging portion 34 and board engaging portion 35. The plurality of contacts have a selected shape, are arranged suitably relative to one another, and are housed collectively by dielectric housing 90 (see FIGS. 28 and 29) so as to minimize crosstalk during data transfer, especially during high frequency data communications.

Figure 28:
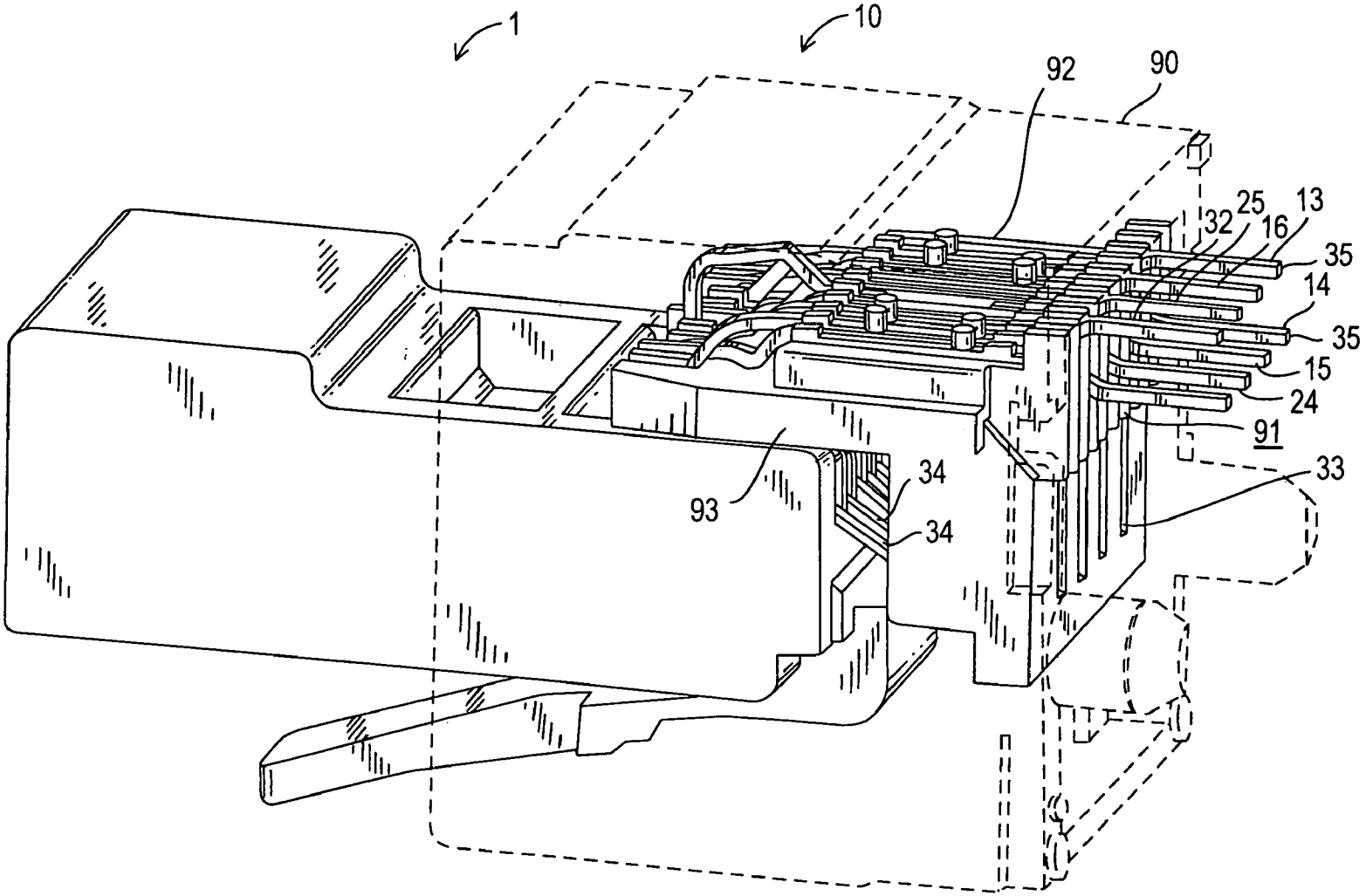
FIG. 28 is a perspective view of the connector housing portions and contacts shown in FIG. 22, fully assembled as a connector jack and in engagement with a plug.
Figure 29:
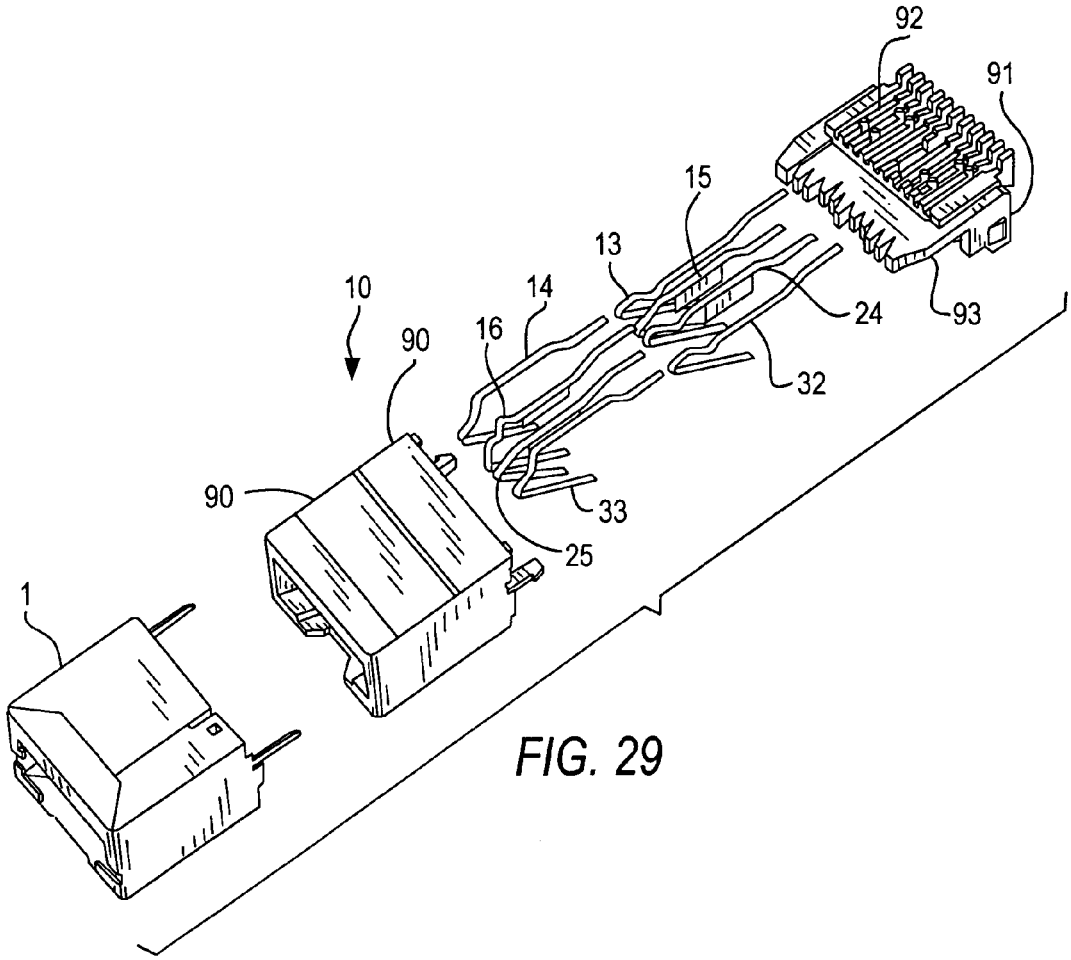
FIG. 29 is an exploded view of connector housing portions and contacts shown in FIG. 28.

Further alternatively or concurrently, as also shown in FIGS. 28 and 29, the dielectric housing 90 includes a sub-assembly or contact receiving part 91 formed suitably with upper and lower contact receiving portions 92, 93, respectively, for receiving corresponding signal pairs and for retaining the contacts of each pair in the desired arrangement, i.e., relative to one another and the housing.

More particularly, each of the upper and lower portions 92, 93 is configured for receiving corresponding inwardly facing portions of the first contact 13, second contact 14, third contact 15, fourth contact 24, fifth contact 16, sixth contact 25, seventh contact 32 and eighth contact 33. From the perspective of the plug engaging portions of the contacts, the fourth contact 24 and fifth contact 16 are in a first signal pair, third contact 15 and sixth contact 25 comprise a second signal pair, first contact 13 and second contact 14 are in a third signal pair and seventh contact 32 and eighth contact 33 constitute a fourth signal pair. Hence, upon engagement of each contact with its corresponding, suitably shaped, upper and lower contact receiving portion, e.g., by friction fit, snap engagement or the like, the first through eighth contacts are located in their respective positions P1 through P8.

Relative to the contacts' board engaging portions, the sequential positions designated P1 to P8 of the first, third and fourth signal pairs are reversed, namely, the fourth contact 24 now occupies position P5 and fifth contact 16 is in position P4, the first contact 13 is now in position P2 whereas second contact 14 occupies position P1, and, finally, the seventh contact 32 occupies position P8 while the eighth contact 33 is now in position P7. The sequential positions of the second signal pair, i.e., the third contact 15 and sixth contact 25, remain the same.

Preferably, the surface of the structure is configured, as with the other embodiments described herein, so as to rise and fall stepwise across its width. This rise and fall pattern forms generally rectangular steps 94 rising from the surface, i.e., where the surface rises and then falls. Where the surface falls and then rises in a rectangular-like fashion, contact receiving detents or channels 95 are formed. The detents desirably have a width suitable for receiving and snugly engaging their respective contacts and extensions thereof. Alternatively, the width is adapted for a loose fit with the respective contact and extensions, the contact being secured in the detent using a suitable adhesive or the like.

Figure 22:
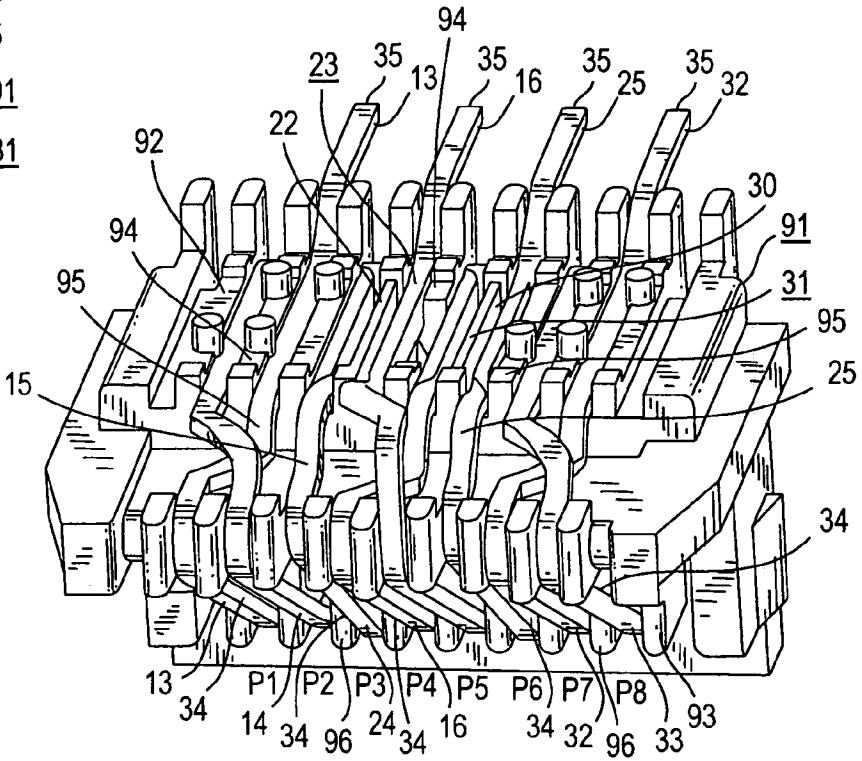
FIG. 22 is a perspective view of a contact locating sub-assembly, according to another aspect of the present invention, showing the respective contacts engaged with upper contact receiving portions of the sub-assembly.
Figure 23:
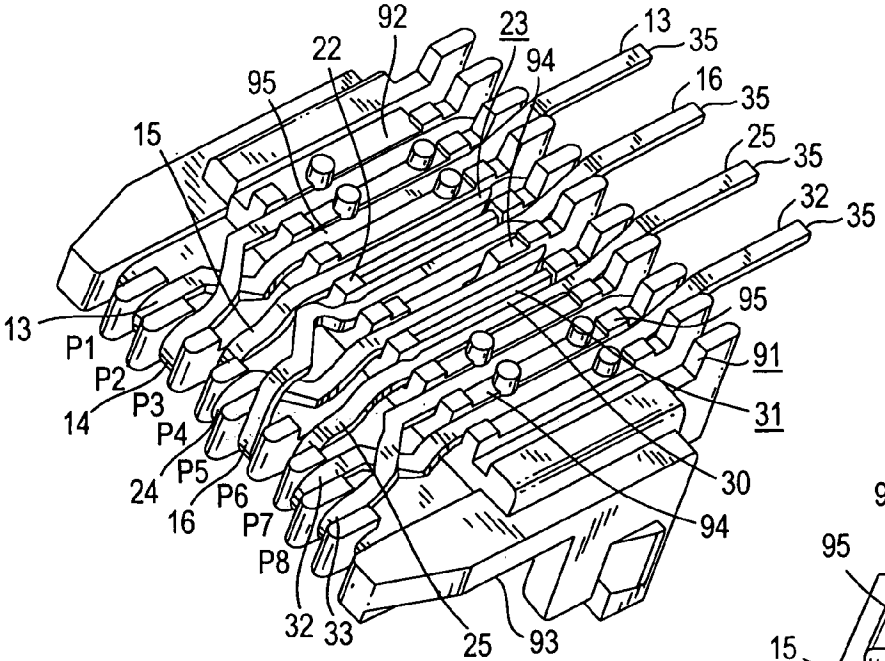
FIG. 23 is a frontal perspective view of the sub-assembly of FIG. 22 showing the respective contacts engaged with upper and lower contact receiving portions of the sub-assembly.
Figure 24:
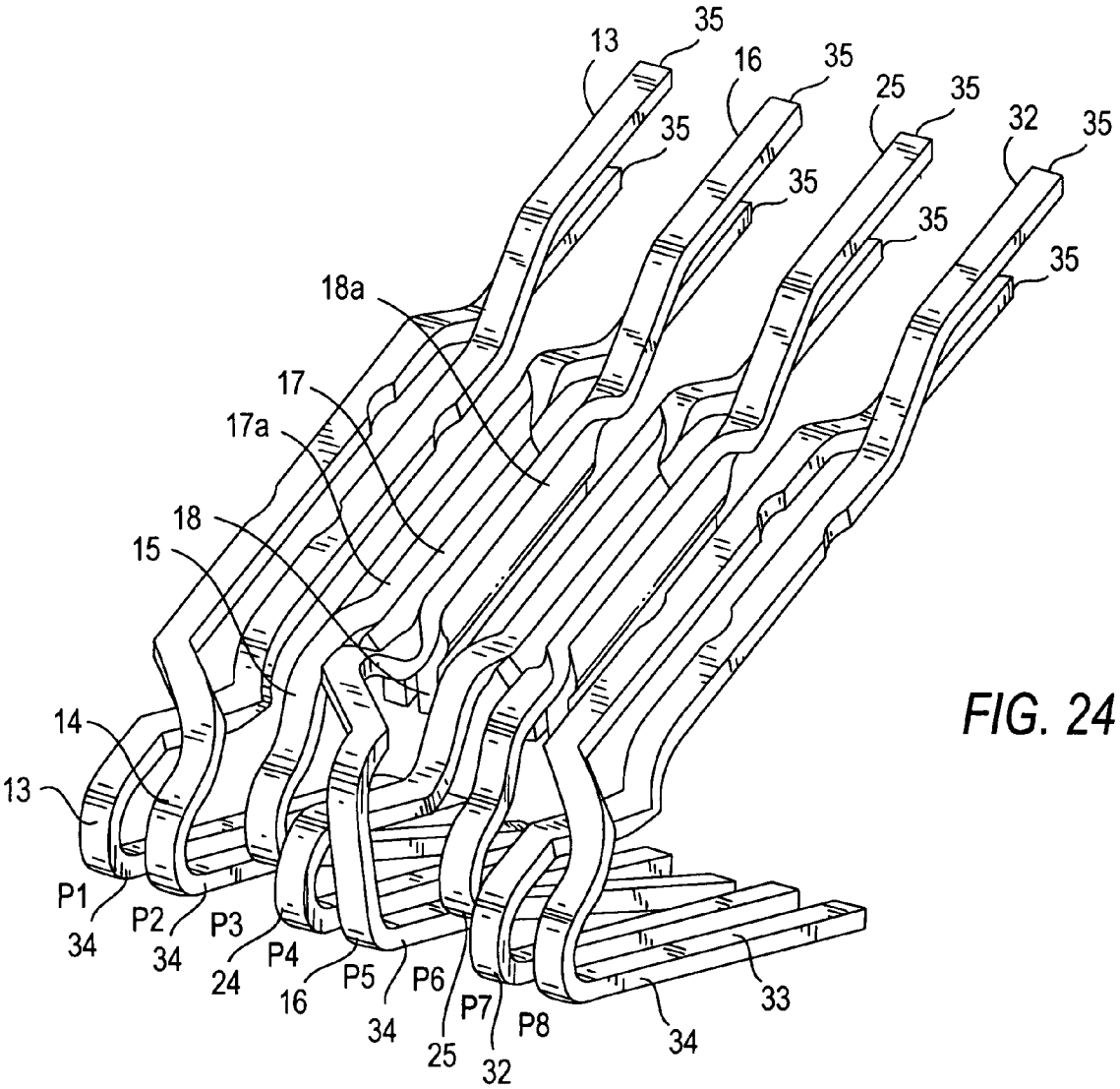
FIG. 24 is a perspective view of a contact and capacitor configuration formed by the sub-assembly shown in FIG. 22.
Figure 25:
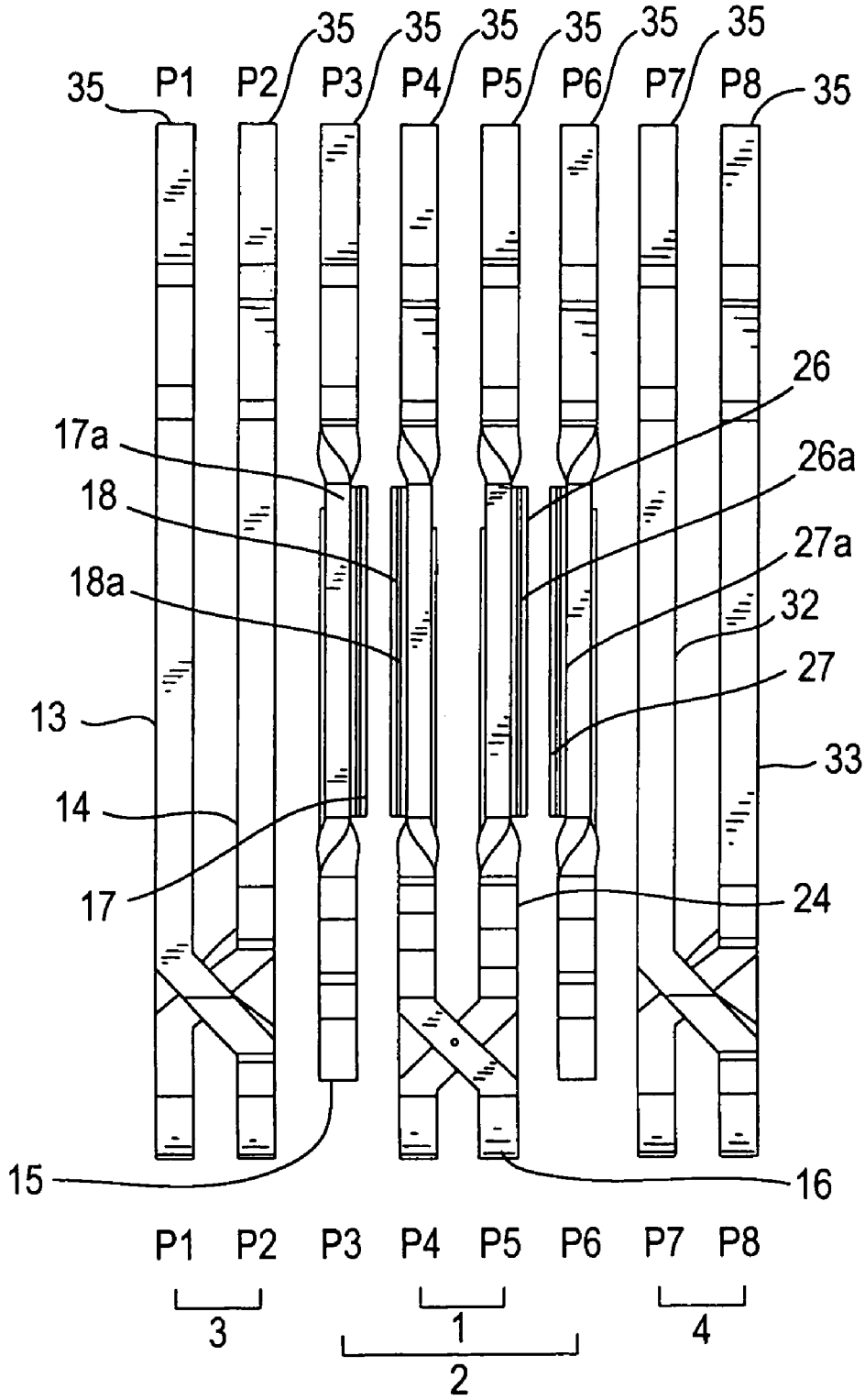
FIG. 25 is a plan view of the contact and capacitor configuration shown in FIG. 24.
Figure 26:
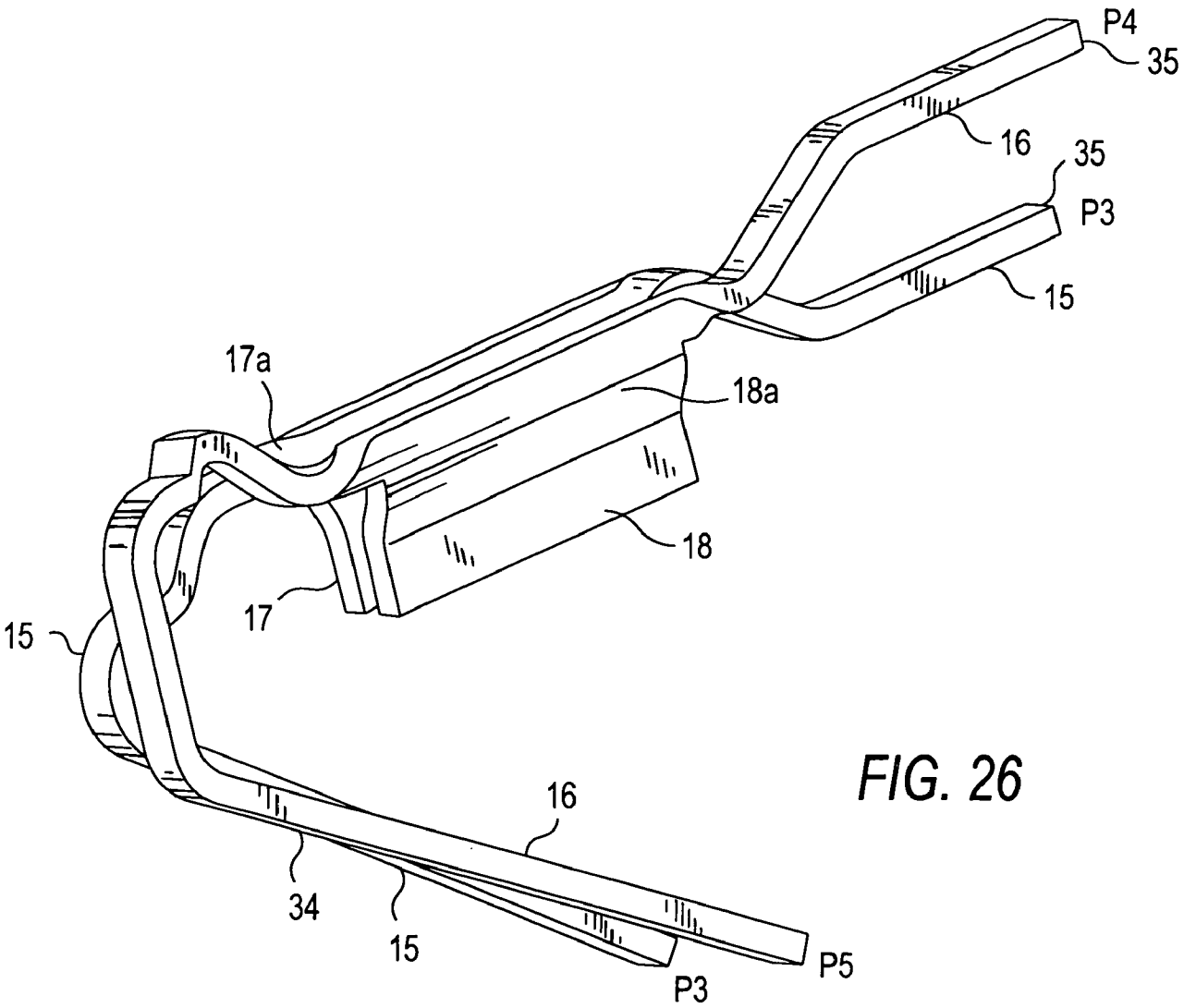
FIG. 26 is a perspective view of the first capacitor formed from plate-like extensions mounted on the third and fifth contacts of the first contact pair shown in FIG. 22.
Figure 26A:
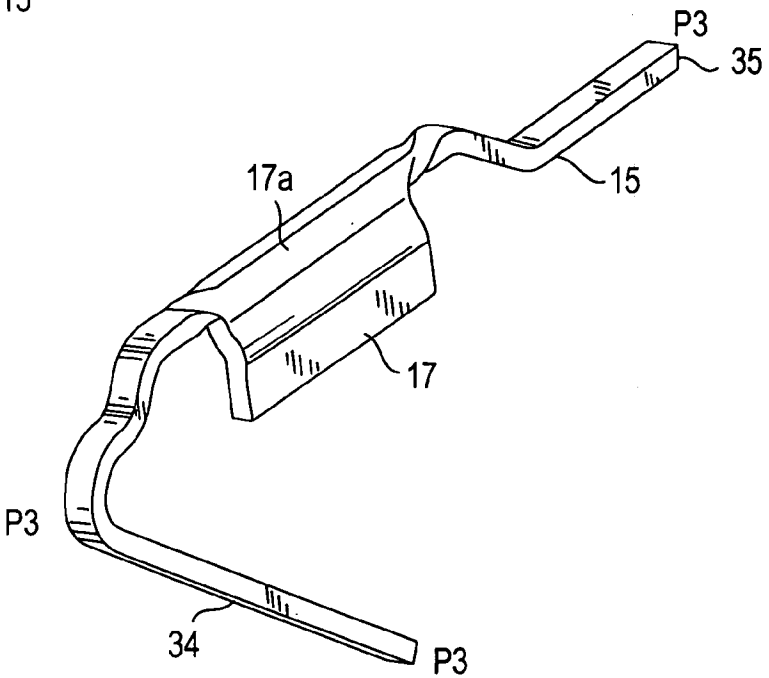
FIG. 26A is a perspective view of the third contact and corresponding plate-like extension shown in FIG. 26.
Figure 26B:
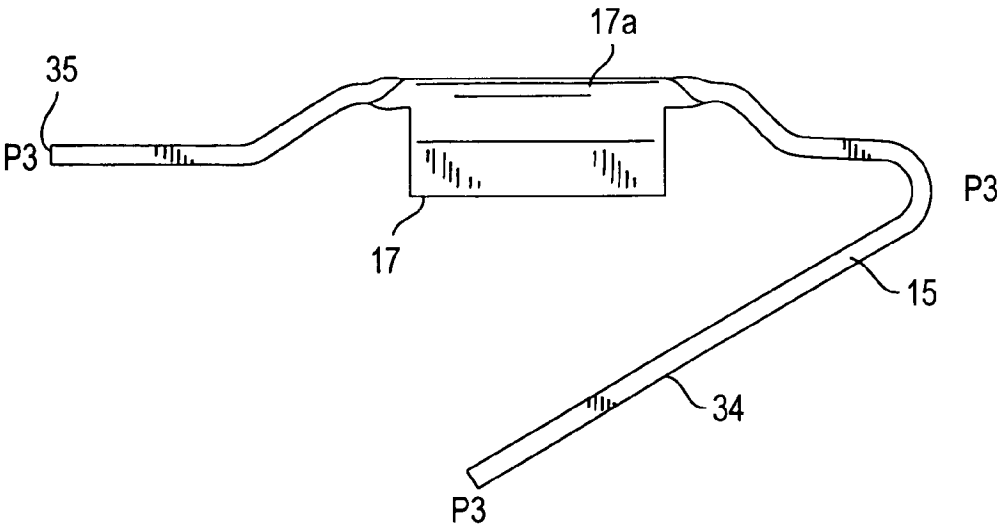
FIG. 26B is a reverse plan view of the third contact and extension shown in FIG. 26A.
Figure 26C:
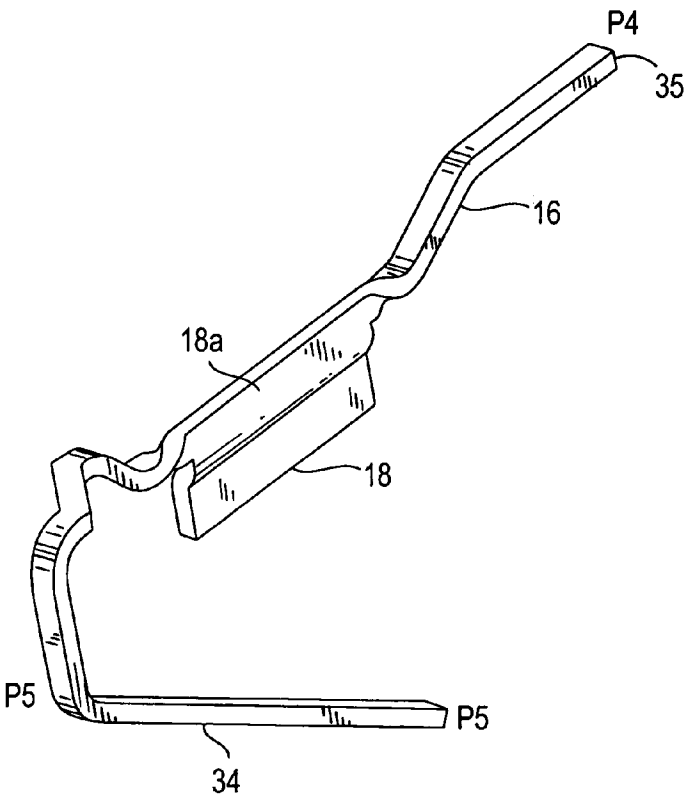
FIG. 26C is a perspective view of the fifth contact and corresponding plate-like extension shown in FIG. 26.
Figure 26D:
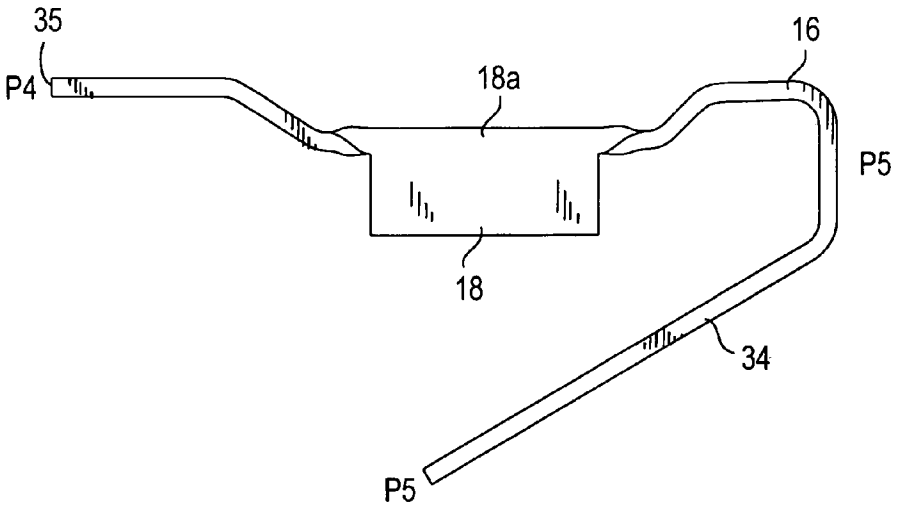
FIG. 26D is a reverse plan view of the fifth contact and extension shown in FIG. 26C.
Figure 27:
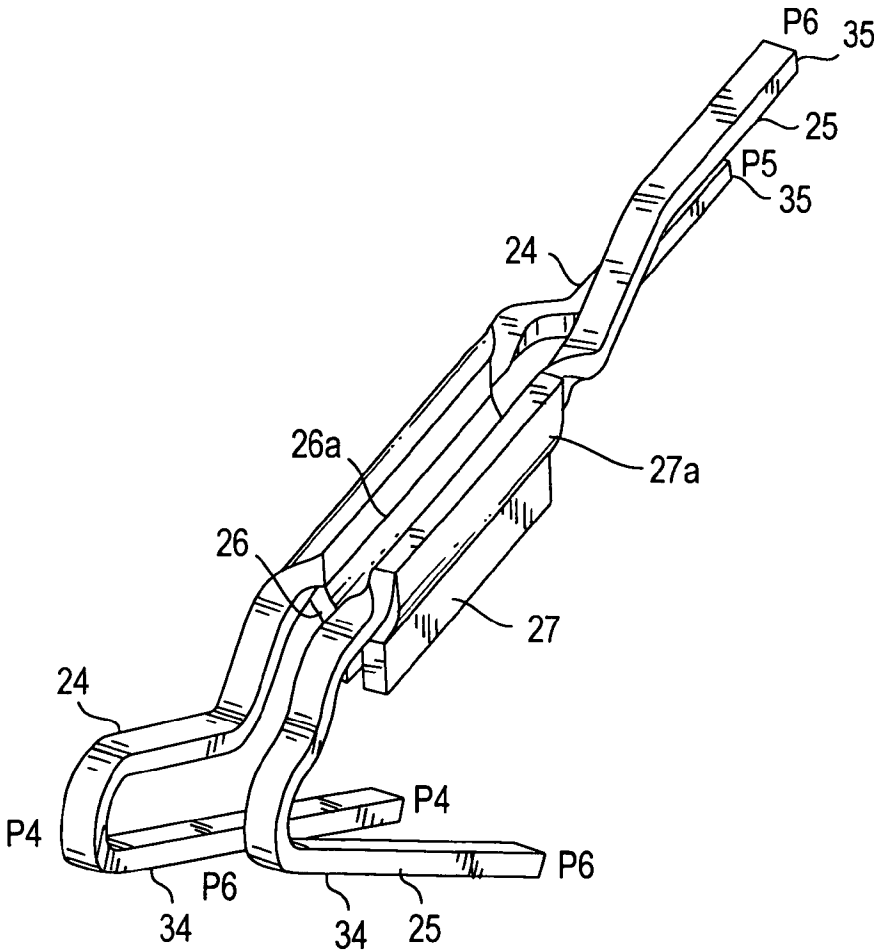
FIG. 27 is a perspective view of the second capacitor formed from plate-like extensions mounted on the fourth and sixth contacts of the second contact pair shown in FIG. 22.
Figure 27A:
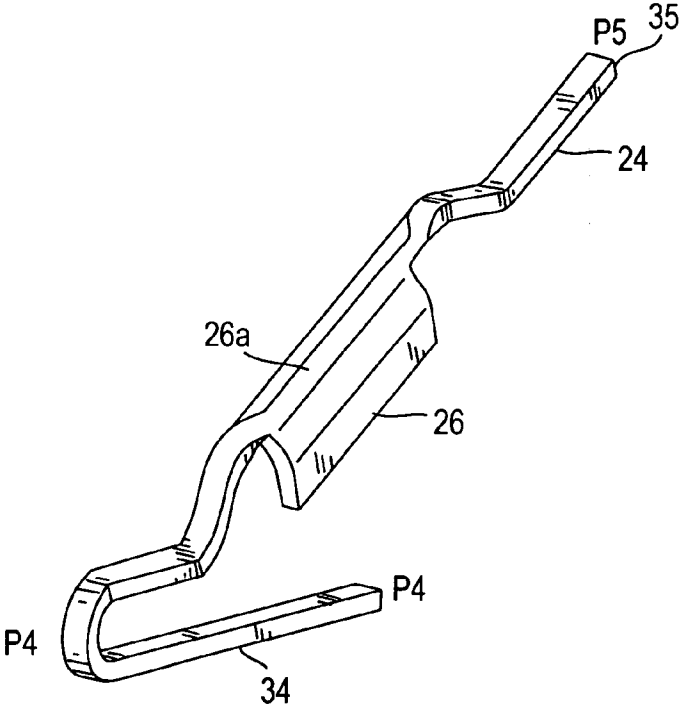
FIG. 27A is a perspective view of the fourth contact and corresponding plate-like extension shown in FIG. 27.
Figure 27B:
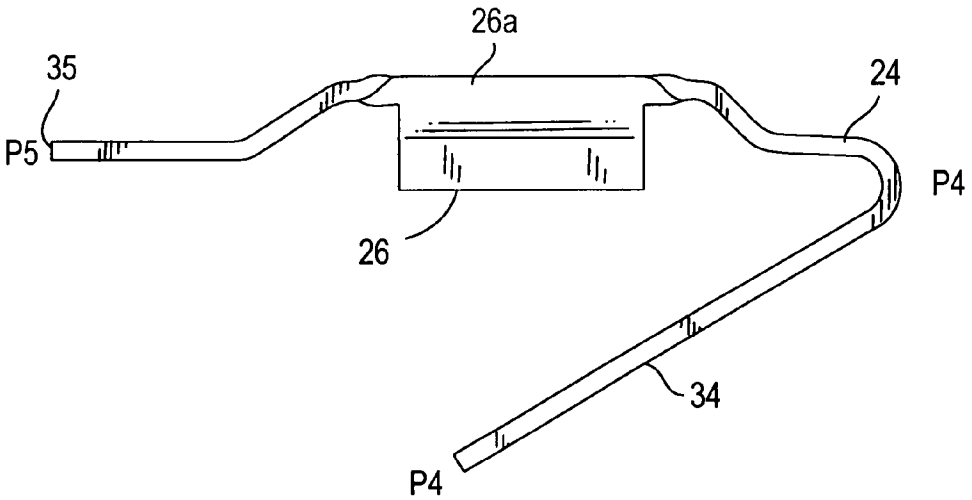
FIG. 27B is a reverse plan view of the fourth contact and extension shown in FIG. 27A.
Figure 27C:
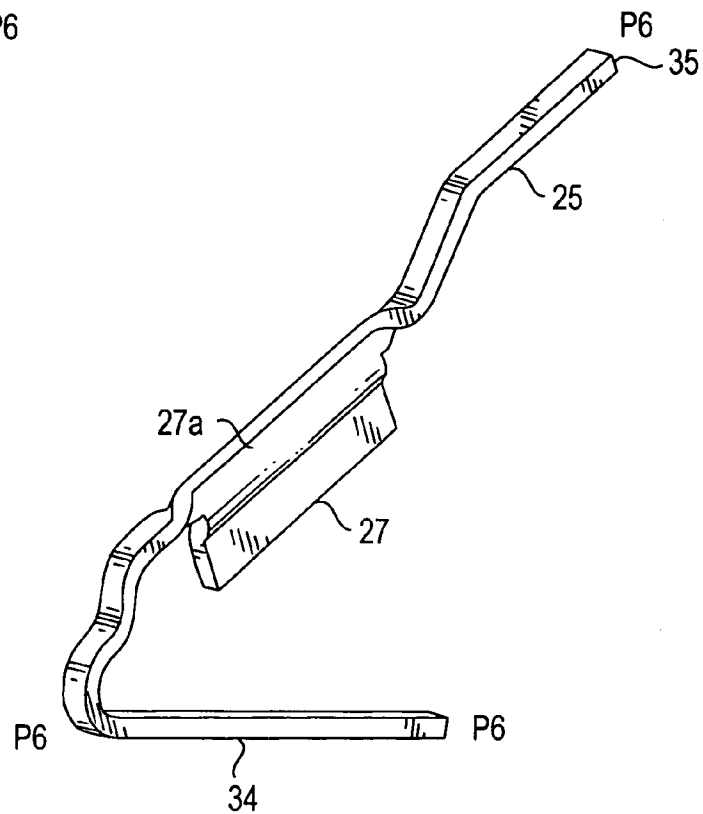
FIG. 27C is a perspective view of the sixth contact and corresponding plate-like extension shown in FIG. 27.
Figure 27D:
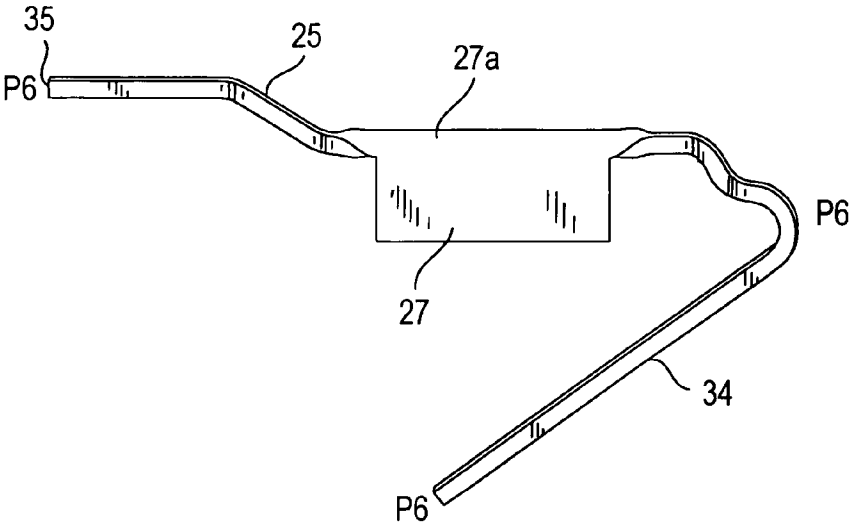
FIG. 27D is a reverse plan view of the sixth contact and extension shown in FIG. 27C.

Between the respective contacts of each pair, the structure rises stepwise so as to form dielectrics 22, 30, respectively, between them. Further alternatively or concurrently, the dielectrics are formed, at least in part, by with complementary falls and rises forming channels 96 in the sub-assembly lower portion 93 adapted for receiving the plug engaging portions of the contacts, thereby securing the contacts and their arc shaped portions about sub-assembly 91, as best seen in FIGS. 22 and 23. By forming the dielectric in this fashion, crosstalk inhibiting properties of the present invention are enhanced.

Referring now to another aspect of the present invention, a method is provided for assembling an electric connector for data transfer applications. First, at least four elongate contact members are connected in at least two signal pairs. A second one of the contact members is paired with a third one of the contact members to form a first signal pair. A first one of the contact members is paired with a fourth one of the contact members to form a second signal pair. Such pairing is done such that one contact member of each contact member pair is configured differently from the other contact member of the pair, the respective contact members being oriented relative to one another such that they remain in generally parallel planes, but define non-parallel paths. Next, a plate-like extension is mounted to each of the first and third contact members. Each plate-like extension is oriented in a first direction and in respective planes generally parallel to one another, and each pair of extensions are separated by a first dielectric such that a first capacitor is formed. Thereafter, a plate-like extension is mounted to each of the second and fourth contact member. Each plate-like extension is oriented in a second direction and in respective planes generally parallel to one another, and each pair of extensions are separated by a second dielectric such that a second capacitor is formed. Finally, a plug engaging portion and a board engaging portion is formed on each contact member pair, the plurality of contact members having a selected shape, being arranged relative to one another, and being housed collectively by a dielectric casing so as to minimize crosstalk during high frequency data transfer.

According to a further aspect of the present invention is a method of assembling an electric connector for data transfer applications. Initially, the plurality of at least eight elongate contact members, i.e., the first through eighth contact members, are connected in a series of at least four signal pairs. The fourth and fifth contact members form a first signal pair. A second signal pair is formed by the third contact member and the sixth contact member. The first and second contact members form a third signal pair. Finally, the seventh contact member and the eighth contact member form a fourth signal pair.

One contact member of each pair is configured differently from the other member of the pair. The respective contact members of each signal pair are also oriented relative to one another such that they remain in generally parallel planes, but define non-parallel paths. In an alternative embodiment, the respective contact members overlap at least once.

A plate-like extension is mounted to each of the third and fifth contact members such that the extensions are oriented in first directions and in respective planes generally parallel to one another. The extensions are separated a selected distance by the first dielectric such that the first capacitor is formed.

Thereafter, plate-like extensions oriented in a second direction, e.g., generally opposite to the first direction, and situated in respective planes generally parallel to one another, are similarly mounted to the fourth and sixth contact members. The extensions are likewise separated a selected distance by the second dielectric such that the second capacitor is formed. Finally, each contact member of each signal pair is provided with the plug engaging portion and the board engaging portion. The plurality of members are formed of the selected shape, arranged relative to one another, and housed collectively by the dielectric casing so as to minimize crosstalk during high frequency data transfer.

Alternatively, another method of assembling an electric connector is performed by first forming the plurality of elongate contact members such that each member has a plug engaging portion and a board engaging portion. At least two of the members are formed so as to have the plate-like extension oriented in the first direction and in respective planes generally parallel to one another. Also, at least two members are formed with the plate-like extension oriented in the second direction, e.g., generally opposite to that of the first direction, and in respective planes generally parallel to one another. Finally, each of the members are formed of a selected shape suitable for minimizing crosstalk during high frequency data transfer.

Next, the contact members are arranged in sequential positions and connected in the series of signal pairs. In particular, the fourth contact member is paired with the fifth contact member to form the first signal pair. The third contact member is paired with the sixth contact member to form the second signal pair. The first contact member is paired with the second contact member to form the third signal pair, and the fourth signal pair is formed by pairing the seventh and eighth contact members. The contact members are formed such that one contact member of each pair is configured differently from the other contact member of the pair. In addition, the respective contact members of each pair are oriented relative to one another such that they remain in generally parallel planes, but define non-parallel paths. Alternatively or concurrently, the respective contact members of each pair overlap at least once.

Thereafter, each of the two contact members having capacitor-forming plate-like extensions, e.g., each of the two contact members having plate-like extensions oriented in the first direction and in respective planes generally parallel to one another, are separated a selected distance by the first dielectric. This forms the first capacitor. Likewise, each of the two members having plate-like extensions oriented in the second direction generally opposite to that of the first direction (and in respective planes generally parallel to one another) are separated a selected distance by the second dielectric such that the second capacitor is formed. Finally, the member pairs are arranged relative to one another and housed collectively by the dielectric casing so as to minimize crosstalk during high frequency data transfer.

In still another embodiment of the present invention, a method is provided for assembling an electric connector for data transfer applications. First, at least four elongate contact members are connected in at least two signal pairs. A second one of the contact members is paired with a third one of the contact members to form a first signal pair. A first one of the contact members is paired with a fourth of the contact members to form a second signal pair. Such pairing is done such that one contact member of each contact member pair is configured differently from the other contact member of the pair, the respective contact members being oriented relative to one another such that they substantially remain in generally parallel planes, but define non-parallel paths. Such pairing is also done such that one member of each signal pair crosses over the other member of the pair so that the positions occupied by the respective members along their non-parallel paths are reversed.

Next, a plate-like extension is mounted to each of the first and third contact members. Each plate-like extension is oriented in a first direction and in respective planes generally parallel to one another, and each pair of extensions are separated by a first dielectric such that a first capacitor is formed. Thereafter, a plate-like extension is mounted to each of the second and fourth contact members. Each plate-like extension is oriented in a second direction and in respective planes generally parallel to one another, and each pair of extensions are separated by a second dielectric such that a second capacitor is formed.

Finally, a plug engaging portion and a board engaging portion is formed on each contact member pair, the plurality of contact members having a selected shape, being arranged relative to one another, and being housed collectively by a dielectric casing so as to minimize crosstalk during high frequency data transfer.

According to a further aspect of the present invention, there is provided a method for assembling a electric connector for data transfer applications. Initially, at least eight elongate contact members are connected in a series of four signal pairs. A fourth one of the contact members is paired with a fifth one of the contact members so as to form a first signal pair. A second signal pair is formed of a third one of the contact members and a sixth one of the contact members. Then, a first one of the contact members and a second one of the contact members are formed in a third signal pair. Finally, a seventh one of the contact members and an eighth one of the contact members are arranged to form a fourth signal pair.

One contact member of each contact member pair is configured differently from the other member of the pair, the respective members being oriented relative to one another such that they substantially remain in generally parallel planes, but define non-parallel paths. Also, one contact member of each of the first, third and fourth signal pairs crosses over the other contact member of the pair such that the positions occupied by the respective contact members along their non-parallel paths are reversed.

Each of the third and fifth contact members mounts a plate-like extension oriented in a first direction and in respective planes generally parallel to one another. Each pair of extensions are separated by a first dielectric such that a first capacitor is formed. Furthermore, each of the fourth and sixth contact members mounts a plate-like extension oriented in a second direction and also in respective planes generally parallel to one another. Each pair of extensions are likewise separated by a second dielectric such that a second capacitor is formed.

Finally, each contact member of each contact member pair has a plug engaging portion and a board engaging portion, the plurality of contact members having a selected shape, being arranged relative to one another, and being housed collectively by a dielectric casing so as to minimize crosstalk during high frequency data transfer.

Figure 30:
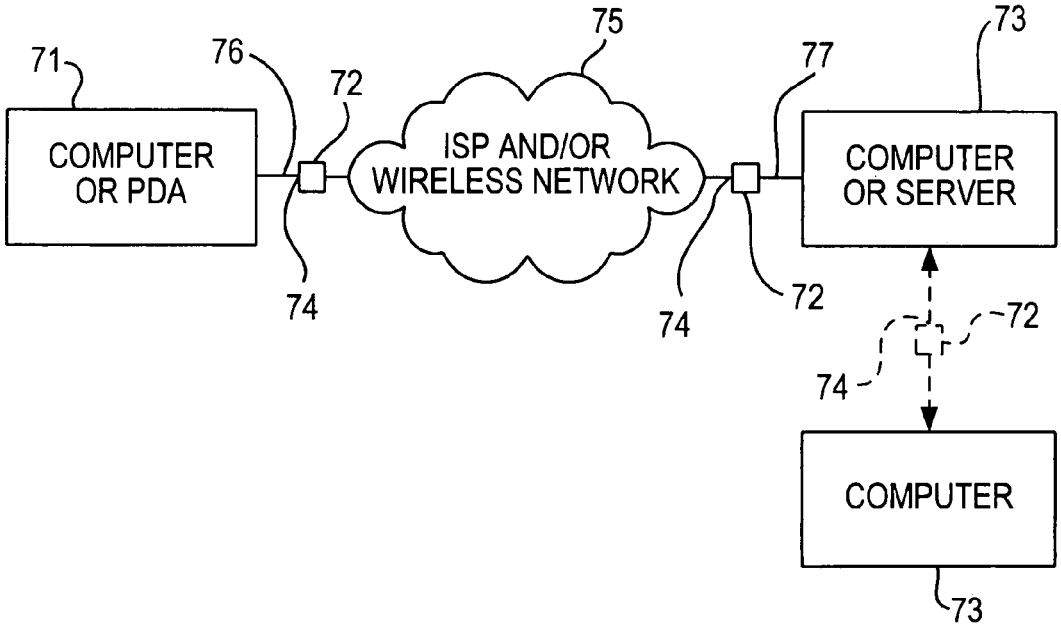
FIG. 30 is a schematic diagram illustrating application of electric connectors for transferring data between electronic devices, according to one aspect of the present invention.

In operation, the present invention provides optimum inhibition of electromagnetic interference during high performance transfer of data between electronic devices. Initially, as illustrated in FIG. 30, a first electronic device 71, e.g., a conventional desktop computer, laptop, videophone, telephone or the like, is joined to jack connector 72. Next, a second electronic device 73 preferably similar to the first is, in turn, joined to a plug connector 74. Finally, the plug connector is inserted into the jack connector such that an electrical connection is established between the first and second electronic devices.

It is preferred that the electric connector comprise a plurality of contacts arranged in sequential positions and connected in at least two signal pairs, as illustrated above. The first signal pair comprises a second contact 24 and a third contact 16, and the second signal pair comprises a first contact 15 and a fourth contact 25. Each of the first and third contacts mounts plate-like extension 17, 18, respectively, oriented in the first direction and in respective planes generally parallel to one another. The extensions are separated the selected distance 21 by first dielectric 22 such that the first capacitor is formed. Similarly, each of the second and fourth contacts mounts plate-like extensions 26, 27, respectively, oriented in the second direction, e.g., generally opposite to that of the first, and also in respective planes generally parallel to one another. The extensions are likewise separated a selected distance 29 by second dielectric 30 such that the second capacitor is formed. Each contact pair has plug engaging and board engaging portions. Further, each of the plurality of contacts has the selected shape, is arranged relative to one another, and is housed collectively by the dielectric casing so as to minimize crosstalk during data transfer.

Alternatively or concurrently, as will be appreciated by those skilled in the art, at least one of the devices, as shown in FIG. 30, is linked to another by an interactive communications network 75, e.g., the Internet, an intranet and/or extranet, a wireless data transmission network, or a combination of the two. Exemplary linking components 76, 77 of communications network 75 include, but are not limited to, wire, fiber optic cable or the like. Also alternatively or concurrently, the first and second electronic devices include a conventional cell phone, personal digital assistant or the like.

While the present invention has been shown and described as a passive connector, i.e., one having no on-board circuitry or other devices for signal conditioning, it is understood that it may be used as an integrated connector such as a connector having a filter circuit, giving consideration to the purpose for which the invention is intended.

Overall, the present invention is advantageous in providing an improved electric connector, a method of assembling the connector, and a method of using the same for high performance data communications. The connector and associated methods are not only simple, practical and economical to implement and produce, but also maintain an optimum level of data transfer as the frequency of transmission increases, all without signal degradation due to crosstalk. The present invention also provides the benefits of enhanced crosstalk compensation and reduction passively, even during the highest performance of applications. This is accomplished, at least in part, through implementation of high capacitance gain producing capacitors within the wire sets. In this manner, the invention provides means for virtually eliminating crosstalk during high frequency communications, that may be readily integrated in the design of existing electric connectors with minimal redesign.

Various modifications and alterations to the present invention may be appreciated based on a review of this disclosure. These changes and additions are intended to be within the scope and spirit of this invention as defined by the following claims.

What is claimed is:

1. An electric connector for data transfer applications, which comprises:

at least four elongate contact members connected in at least two signal pairs;

a first signal pair including a second contact member and a third contact member and a second signal pair comprising a first contact member and a fourth contact member, one member of each signal pair being configured differently from the other member of the pair, and the respective members of each signal pair being oriented relative to one another such that they substantially remain in generally parallel planes, but define non-parallel paths;

each of the first and third members mounting a plate-like extension oriented in a first direction and in respective planes generally parallel to one another, each pair of extensions being separated by a first dielectric such that a first capacitor is formed;

each of the second and fourth members mounting a plate-like extension oriented in a second direction and in respective planes generally parallel to one another, each pair of extensions being separated by a second dielectric such that a second capacitor is formed; and each contact member of each signal pair including a plug engaging portion and a board engaging portion, the plurality of contact members having a selected shape, being arranged relative to one another, and being housed collectively by a dielectric casing so as to minimize crosstalk during data transfer.

2. The electric connector set forth in claim 1 wherein at least one of the dielectrics comprises a polymeric material.

3. The electric connector set forth in claim 1 wherein the casing comprises a polymeric material having a relatively high dielectric value.

4. The electric connector set forth in claim 1 wherein at least one of the conductive members includes commercially pure copper.

5. The electric connector set forth in claim 1 wherein at least one of the capacitors is a flat plate capacitor.

6. The electric connector set forth in claim 1 wherein each conductive member having a plate-like extension is formed with the extension as a one piece unit.

7. The electric connector set forth in claim 1 wherein the total surface area of the extensions of the first capacitor is generally equivalent to that of the second capacitor extensions.

8. The electric connector set forth in claim 1 wherein the total surface area of the extensions of the first capacitor is generally unequal to that of the second capacitor extensions.

9. An electric connector for data transfer applications, which comprises:

at least eight elongate contact members connected in at least two signal pairs;

a first signal pair including a fourth contact member and a fifth contact member and a second signal pair comprising a third contact member and a sixth contact member, one member of each signal pair being configured differently from the other member of the pair, and the respective members of each signal pair being oriented relative to one another such that they remain in generally parallel planes, but define non-parallel paths;

each of the third and fifth members mounting a plate-like extension oriented in a first direction and in respective planes generally parallel to one another, each pair of extensions being separated by a first dielectric such that a first capacitor is formed;

each of the fourth and sixth members mounting a plate-like extension oriented in a second direction and in respective planes generally parallel to one another, each pair of extensions being separated by a second dielectric such that a second capacitor is formed; and each contact member of each signal pair including a plug engaging portion and a board engaging portion, the plurality of contact members having a selected shape, being arranged relative to one another, and being housed collectively by a dielectric casing so as to minimize crosstalk during data transfer.

10. The electric connector set forth in claim 9 wherein at least one of the dielectrics comprises a polymeric material.

11. The electric connector set forth in claim 9 wherein the casing comprises a polymeric material having a relatively high dielectric value.

12. The electric connector set forth in claim 9 wherein at least one of the conductive members includes commercially pure copper.

13. The electric connector set forth in claim 9 wherein at least one of the capacitors is a flat plate capacitor.

14. The electric connector set forth in claim 9 wherein each conductive member having a plate-like extension is formed with the extension as a one piece unit.

15. The electric connector set forth in claim 9 wherein the total surface area of the extensions of the first capacitor is generally equivalent to that of the second capacitor extensions.

16. The electric connector set forth in claim 9 wherein the total surface area of the extensions of the first capacitor is generally unequal to that of the second capacitor extensions.

17. A high performance, high capacitance gain, electric connector for data transfer applications, which comprises:

at least eight sequentially positioned contacts connected in at least four signal pairs;

a first signal pair including a fourth contact and a fifth contact, a second signal pair comprising a third contact and a sixth contact, a third signal pair including a first contact and a second contact, and a fourth signal pair having a seventh contact and an eighth contact;

one contact of each pair being configured differently from the other contact of the pair, and the respective contacts of each pair being oriented relative to one another such that they remain in generally parallel planes, but define non-parallel paths;

each of the third and fifth contacts mounting a plate-like extension oriented in a first direction and in respective planes generally parallel to one another, each pair of extensions being separated by a first dielectric such that a first capacitor is formed;

each of the fourth and sixth contacts mounting a plate-like extension oriented in a second direction and in respective planes generally parallel to one another, each pair of extensions being separated by a second dielectric such that a second capacitor is formed; and each contact of each signal pair including a plug engaging portion and a board engaging portion, the plurality of contacts having a selected shape, being arranged relative to one another, and being housed collectively by a dielectric casing so as to minimize crosstalk during high frequency data transfer.

18. The electric connector set forth in claim 17 wherein the dielectric casing comprises a polymeric material.

19. The electric connector set forth in claim 17 wherein the casing comprises a polymeric material having a relatively high dielectric value.

20. The electric connector set forth in claim 17 wherein at least one of the contacts includes commercially pure copper.

21. The electric connector set forth in claim 17 wherein at least one of the capacitors is a flat plate capacitor.

22. The electric connector set forth in claim 17 wherein each contact having a plate-like extension is formed with the extension as a one piece unit.

23. The electric connector set forth in claim 17 wherein the total surface area of the extensions of the first capacitor is generally equivalent to that of the second capacitor extensions.

24. The electric connector set forth in claim 17 wherein the total surface area of the extensions of the first capacitor is generally unequal to that of the second capacitor extensions.

25. An electric connector for data transfer applications, which comprises:

at least eight elongate contact members connected in a plurality of signal pairs;

a first signal pair including a fourth contact member and a fifth contact member, a second signal pair comprising a third contact member and a sixth contact member, a third signal pair including a first contact member and a second contact member; and a fourth signal pair having a seventh contact member and an eighth contact member;

one member of each signal pair being configured differently from the other member of the pair, and the respective members of each signal pair being oriented relative to one another such that they remain in generally parallel planes, but define non-parallel paths;

each of the third and fifth members mounting a plate-like extension oriented in a first direction and in respective planes generally parallel to one another, each pair of extensions being separated by a first dielectric such that a first capacitor is formed;

each of the fourth and sixth members mounting a plate-like extension oriented in a second direction and in respective planes generally parallel to one another, each pair of extensions being separated by a second dielectric such that a second capacitor is formed; and each contact member of each signal pair including a plug engaging portion and a board engaging portion, the plurality of contact members having a selected shape, being arranged relative to one another, and being housed collectively by a dielectric casing so as to minimize crosstalk during data transfer.

26. The electric connector set forth in claim 25 wherein at least one of the dielectrics comprises a polymeric material.

27. The electric connector set forth in claim 25 wherein the casing comprises a polymeric material having a relatively high dielectric value.

28. The electric connector set forth in claim 25 wherein at least one of the conductive members includes commercially pure copper.

29. The electric connector set forth in claim 25 wherein at least one of the capacitors is a flat plate capacitor.

30. The electric connector set forth in claim 25 wherein each conductive member having a plate-like extension is formed with the extension as a one piece unit.

31. The electric connector set forth in claim 25 wherein the total surface area of the extensions of the first capacitor is generally equivalent to that of the second capacitor extensions.

32. The electric connector set forth in claim 25 wherein the total surface area of the extensions of the first capacitor is generally unequal to that of the second capacitor extensions.

33. A high performance, high capacitance gain, electric connector for data transfer applications, which comprises:

at least eight sequentially positioned contacts connected in a plurality of signal pairs;

a first signal pair including a fourth contact and a fifth contact, a second signal pair comprising a third contact and a sixth contact, a third signal pair including a first contact and a second contact, and a fourth signal pair having a seventh contact and an eighth contact;

one contact of each pair being configured differently from the other contact of the pair, and the respective contacts of each pair being oriented relative to one another such that they remain in generally parallel planes, but define non-parallel paths;

each of the third and fifth contacts mounting a plate-like extension oriented in a first direction and in respective planes generally parallel to one another, each pair of extensions being separated by a first dielectric such that a first capacitor is formed;

each of the fourth and sixth contacts mounting a plate-like extension oriented in a second direction generally opposite to that of the first direction and in respective planes generally parallel to one another, each pair of extensions being likewise separated by a second dielectric such that a second capacitor is formed;

the total surface area of the extensions of the first capacitor being generally equal to that of the second capacitor extensions; and each contact of each contact pair including a plug engaging portion and a board engaging portion, the plurality of contacts having a selected shape, being arranged relative to one another, and being housed collectively by a dielectric casing so as to minimize crosstalk during high frequency data transfer.

34. A high performance, high capacitance gain, electric connector for data transfer applications, which comprises:

at least eight sequentially positioned contacts connected in a plurality of signal pairs;

a first signal pair including a fourth contact and a fifth contact, a second signal pair comprising a third contact and a sixth contact, a third signal pair including a first contact and a second contact, and a fourth signal pair having a seventh contact and an eighth contact;

one contact of each pair being configured differently from the other contact of the pair, and the respective contacts of each pair being oriented relative to one another such that they remain in generally parallel planes, but define non-parallel paths;

each of the third and fifth contacts mounting a plate-like extension oriented in a first direction and in respective planes generally parallel to one another, each pair of extensions being separated by a first dielectric such that a first capacitor is formed;

each of the fourth and sixth contacts mounting a plate-like extension oriented in a second direction generally opposite to that of the first direction and in respective planes generally parallel to one another, each pair of extensions being likewise separated by a second dielectric such that a second capacitor is formed;

the total surface area of the extensions of the first capacitor being generally unequal to that of the second capacitor extensions; and each contact of each contact pair including a plug engaging portion and a board engaging portion, the plurality of contacts having a selected shape, being arranged relative to one another, and being housed collectively by a dielectric casing so as to minimize crosstalk during high frequency data transfer.

35. A high performance, high capacitance gain, electric connector for data transfer applications, which comprises:

at least eight sequentially positioned elongate contact members connected in a plurality of signal pairs;

a first signal pair including a fourth contact member and a fifth contact member, and a second signal pair comprising a third contact member and a sixth contact member;

each of the third and fifth contact members mounting a plate-like extension oriented in a first direction downwardly from the third and fifth contact members and in respective planes generally parallel to one another, each pair of extensions being separated by a first dielectric having a relatively high dielectric value such that a first high gain capacitor is formed;

each of the fourth and sixth contact members mounting a plate-like extension oriented in a second direction upwardly from the fourth and sixth contact members and in respective planes generally parallel to one another, each pair of extensions being separated by a second dielectric having a relatively high dielectric value such that a second high gain capacitor is formed; and each contact member of each contact member pair including a plug engaging portion and a board engaging portion, the plurality of contact members having a selected shape, being arranged relative to one another, and being housed collectively by a dielectric casing so as to minimize crosstalk during high frequency data transfer.

36. A method of assembling an electric connector for data transfer applications, which comprises the steps of:

I. connecting at least four elongate contact members in at least two signal pairs;

ii. pairing a third one of the contact members with a sixth one of the contact members to form a first signal pair; and iii. pairing a fourth one of the contact members with a fifth one of the contact members to form a second signal pair;

such that one contact member of each contact member pair is configured differently from the other contact member of the pair, the respective contact members being oriented relative to one another such that they remain in generally parallel planes, but define non-parallel paths;

iv. mounting to each of the third and fifth contact members a plate-like extension oriented in a first direction and in respective planes generally parallel to one another, each pair of extensions being separated by a first dielectric such that a first capacitor is formed;

v. mounting to each of the fourth and sixth contact members a plate-like extension oriented in a second direction and in respective planes generally parallel to one another, each pair of extensions being separated by a second dielectric such that a second capacitor is formed; and vi. forming on each contact member pair a plug engaging portion and a board engaging portion, the plurality of contact members having a selected shape, being arranged relative to one another, and being housed collectively by a dielectric casing so as to minimize crosstalk during high frequency data transfer.

37. A method of assembling an electric connector for data transfer applications, which comprises the steps of:

I. connecting at least eight elongate contact members in a series of four signal pairs;

ii. pairing a fourth one of the contact members with a fifth one of the contact members to form a first signal pair;

iii. pairing a third one of the contact members with a sixth one of the contact members to form a second signal pair;

iv. pairing a first one of the contact members with a second one of the contact members to form a third signal pair; and v. pairing a seventh one of the contact members with an eighth one of the contact members to form a fourth signal pair, such that one contact member of each contact member pair is configured differently from the other contact member of the pair, the respective members being oriented relative to one another such that they remain in generally parallel planes, but define non-parallel paths;

vi. mounting to each of the third and fifth contact members a plate-like extension oriented in a first direction and in respective planes generally parallel to one another, each pair of extensions being separated by a first dielectric such that a first capacitor is formed;

vii. mounting to each of the fourth and sixth contact members a plate-like extension oriented in a second direction and in respective planes generally parallel to one another, each pair of extensions being separated by a second dielectric such that a second capacitor is formed; and viii. forming on each contact member pair a plug engaging portion and a board engaging portion, the plurality of contact members having a selected shape, being arranged relative to one another, and being housed collectively by a dielectric casing so as to minimize crosstalk during high frequency data transfer.

38. A method of assembling an electric connector for data transfer applications, which comprises the steps of:

I. forming at least eight elongate contact members such that each member has a plug engaging portion and a board engaging portion, at least two of the contact members being formed so as to each have a plate-like extension oriented in a first direction and in respective planes generally parallel to one another, and at least two of the contact members being formed so as to each have a plate-like extension oriented in a second direction and in respective planes generally parallel to one another, such that each contact member has a selected shape suitable for minimizing crosstalk during high frequency data transfer;

ii. arranging the contact members in sequential positions and connecting them in a series of signal pairs, pairing a fourth one of the contact members with a fifth one of the contact members to form a first signal pair, pairing a third one of the contact members with a sixth one of the contact members to form a second signal pair, pairing a first one of the contact members with a second one of the contact members to form a third signal pair, and pairing a seventh one of the contact members with an eighth one of the contact members to form a fourth signal pair; such that one contact member of each pair is configured differently from the other contact member of the pair, the respective contact members being oriented relative to one another such that they remain in generally parallel planes, but define non-parallel paths;

iii. separating each of the two contact members having plate-like extensions oriented in a first direction and in respective planes generally parallel to one another, by a first dielectric such that a first capacitor is formed;

iv. separating each of the two contact members having plate-like extensions oriented in a second direction and in respective planes generally parallel to one another, by a second dielectric such that a second capacitor is formed; and v. arranging each of the contact member pairs relative to one another and housing them collectively by a dielectric casing so as to minimize crosstalk during high frequency data transfer.

39. A plurality of elongate contact members for use in a jack connector for high performance data transfer:

the contact members including wires arranged sequentially and connected in a series of signal pairs;

a first signal pair comprising a first contact member and a third contact member, the first and third contact members each mounting a plate-like extension oriented in a first direction and in respective planes generally parallel to one another, each pair of extensions being separated by a first dielectric having a relatively high dielectric value such that a first high gain capacitor for minimizing crosstalk is formed; and a second signal pair having a second contact member and a fourth contact member, the second and fourth contact members each mounting a plate-like extension oriented in a second direction opposite to the first direction and in respective planes generally parallel to one another, each pair of extensions being separated by a second dielectric insert having a relatively high dielectric value such that a second high gain capacitor for minimizing crosstalk is formed.

* * * * *